US005190289A

United States Patent [19]

Nagai et al.

[11] Patent Number: 5,190,289

[45] Date of Patent: Mar. 2, 1993

[54] GOLF CLUB

[75] Inventors: Masao Nagai, Osaka, Japan; Paolo Pininfarina, Cambiano, Italy

[73] Assignee: Mizuno Corporation, Osaka, Japan

[21] Appl. No.: 669,721

[22] Filed: Mar. 14, 1991

[30] Foreign Application Priority Data

Mar. 15, 1990 [JP] Japan ..... 2-65768

[51] Int. Cl.[5] ..... A63B 53/00; A63B 53/04

[52] U.S. Cl. ..... 273/167 E; 273/167 J; 273/80 B

[58] Field of Search ..... 273/167–175, 273/77 R, 77 A, 193 R, 194 R, 80 R–80.9, DIG. 7, DIG. 23, 164; D21/214–220

[56] References Cited

U.S. PATENT DOCUMENTS

| | | | |
|---|---|---|---|
| 703,519 | 7/1902 | Becker | 273/173 X |
| 1,396,470 | 11/1921 | Taylor | 273/167 E |
| 1,528,017 | 3/1925 | Gammeter | 273/80 R X |
| 1,637,735 | 8/1927 | Collinson | 273/80.2 |
| 2,088,095 | 7/1937 | Sargent et al. | 273/80 C |
| 2,908,502 | 10/1959 | Bradstreet | 273/167 J |
| 2,954,231 | 9/1960 | Macintyre | 273/80 R X |
| 3,836,153 | 9/1974 | Dance, Jr. | 273/173 |
| 3,869,126 | 3/1975 | Thompson | 273/175 |
| 3,975,023 | 8/1976 | Inamori | 273/173 |
| 3,985,363 | 10/1976 | Jepson et al. | 273/173 |
| 3,989,861 | 11/1976 | Rasmussen | 273/167 J X |
| 4,023,802 | 5/1977 | Jepson et al. | 273/80.5 |
| 4,065,133 | 12/1977 | Gordos | 273/167 E |
| 4,077,632 | 3/1978 | Taylor | 273/164 |
| 4,188,032 | 2/1980 | Yanagioka | 273/80 R |
| 4,213,614 | 7/1980 | Philippi | 273/194 B |
| 4,552,713 | 11/1985 | Cavicchioli | 273/80 R X |
| 4,754,974 | 7/1988 | Kobayashi | 273/167 E |
| 4,768,787 | 9/1988 | Shira | 273/175 |
| 4,792,140 | 12/1988 | Yamaguchi et al. | 273/173 |
| 4,793,616 | 12/1988 | Fernandez | 273/167 H |
| 4,809,983 | 3/1989 | Langert | 273/167 E |
| 4,951,953 | 8/1990 | Kim | 273/80 B |

FOREIGN PATENT DOCUMENTS

| | | | |
|---|---|---|---|
| 268181 | 7/1965 | Australia | 273/167 J |
| 0021937 | 2/1977 | Japan | 273/167 J |
| 58-70266 | 4/1983 | Japan . | |
| 59-220344 | 12/1984 | Japan . | |
| 62-176469 | 8/1987 | Japan . | |
| 489638 | 10/1936 | United Kingdom | 273/80 R |
| 1499470 | 2/1978 | United Kingdom . | |
| 2012597 | 8/1979 | United Kingdom . | |

*Primary Examiner*—V. Millin
*Assistant Examiner*—Sebastiano Passaniti
*Attorney, Agent, or Firm*—Keck, Mahin & Cate

[57] ABSTRACT

A golf club is composed of a head, a shaft, a grip and the like, and includes a roughened surface portion capable of reducing the value of air resistance by forming a turbulent boundary layer around the head when a golfer swings. The golf club, the roughened surface portion is annularly formed in a peripheral portion of the face portion of the head a neck portion and a socket portion of the head and/or at least a portion of the shaft adjacent to the head.

13 Claims, 18 Drawing Sheets

STATE OF INTERSECTION OF AIR FLOWS GOLF CLUB ACCORDING TO THE PRESENT INVENTION (SURFACE ROUGHNESS ABOUT 100μS)

STATE OF DRAG
GOLF CLUB ACCORDING TO THE PRESENT INVENTION
(SURFACE ROUGHNESS ABOUT 100μS)

ROUGHENED SURFACE TREATMENT AND VALUE OF AIR RESISTANCE WITH RESPECT TO WIND SPEEDS (GOLF CLUB)

○ CONVENTIONAL GOLF CLUB (ENTIRE SURFACE IS SMOOTH)

□ GOLF CLUB ACCORDING TO THE PRESENT INVENTION (SURFACE ROUGHNESS ABOUT 50μS)

▲ GOLF CLUB ACCORDING TO THE PRESENT INVENTION (SURFACE ROUGHNESS ABOUT 100μS)

ROUGHENED SURFACE TREATMENT AND VALUE OF AIR RESISTANCE WITH RESPECT TO WIND SPEEDS (GOLF SHAFT)

○ CONVENTIONAL SHAFT (ENTIRE SURFACE IS SMOOTH)

△ SHAFT ACCORDING TO THE COMPARATIVE TEST (SURFACE ROUGHNESS 50μS OR LESS)

● SHAFT ACCORDING TO THE PRESENT INVENTION (SURFACE ROUGHNESS ABOUT 100μS)

STATE OF INTERSECTION OF AIR FLOWS
CONVENTIONAL GOLF CLUB
(ENTIRE SURFACE IS SMOOTH)

STATE OF DRAG CONVENTIONAL GOLF CLUB
ENTIRE SURFACE IS SMOOTH

GOLF CLUB

BACKGROUND OF THE INVENTION

1. Field of the Invention

The present invention relates to an improvement in reducing the value of air resistance of a golf club.

2. Description of Related Art

Hitherto, a golf club and, more particularly, a so-called wood club, has been used in order to drive a golf ball farther. Therefore, it has been necessary to reduce the value of air resistance so as to raise the head speed of the golf club when the golf club is swung.

As shown in FIGS. 32 and 33, which illustrate the results of a wind tunnel test to which an ordinary golf club has been subjected, an air flow passing in a direction from the face of the head toward the back portion is expressed as small dots denoting small resistance and as various arrows in the portions around the head and in the back portion.

This represents a laminar boundary layer which is generated around the head in a direction from the face of the head to the back portion of the same. Furthermore, the air flow is separated from the surface of the head at the rear end portion of the above-described laminar boundary layer, causing a negative pressure region to be formed behind the head. In consequence, an undesirable eddy current is generated around the head. In the above-described state, air in front of the head is compressed and its pressure is thereby raised. On the other hand, air pressure behind the head is reduced, causing a pressure difference to be generated across the head. Therefore, as is well known, drag, which will reduce the head speed, will be generated.

Furthermore, if a boundary layer, referred to as a "turbulent boundary layer", is formed on the surface of the head, the air flow cannot easily be separated from the surface of the head, causing the negative pressure portion behind the head to be reduced. Therefore, as is well known, the drag, which will reduce the head speed, can be reduced.

Although a phenomenon similar to the above-described fact is also generated in the shaft portion of the golf club, the head and the shaft have different Reynolds numbers and the mechanisms which will generate the drag are different since the head and the shaft have different sizes.

Inventions found depending upon the above-described phenomenon have been disclosed in Japanese Laid-Open Patent Publication No. 62-176469 and Japanese Utility Model Laid-Open Publication No. 58-70266.

The above-described conventional golf clubs have been arranged as follows:

For example, according to Japanese Laid-Open Patent Publication No. 62-176469, there has been disclosed a head of a golf club arranged in such a manner that surface treatment for forming a turbulent boundary layer is applied to substantially the entire surface of the head from a portion in the vicinity of the face thereof to the rear side of the same. Another golf club has been known which has been, as shown in FIG. 27, arranged in such a manner that a multiplicity of thin grooves are formed in the surface of the head. Furthermore, there has been a golf club as shown in FIG. 28 and arranged in such a manner that grooves are formed in the entire surface of the head in such a manner that the grooves extend substantially parallel to the face of the head.

In addition, a golf club has been known which is arranged in such a manner that the entire surface of the head is formed in a pile surface as shown in FIG. 29.

As for the shaft of a golf club, there has been disclosed a golf club in Japanese Utility Model Laid-Open Publication No. 58-70266. According to this disclosure, the golf club having a head and a grip comprises a shaft which has linear projections formed in at least its surface near the head, the linear projections being capable of changing a laminar boundary layer of an air flow, which passes along the surface of the head when it is swung, into a turbulent boundary layer. In addition, a shaft as shown in FIG. 30 has been known which is arranged in such a manner that the linear projections to be formed on the surface of the shaft are disposed near the laminar separation point. Furthermore, a shaft as shown in FIG. 31 has been known which is arranged in such a manner that the linear projections to be formed on the surface of the shaft are disposed at positions which make an angle of 60° to 70° from the center line of an air flow which passes along the above-described surface.

However, any of the above-described structures involve a disadvantage in that air resistance reduction of the overall body of the golf club including the head, the hosel and the shaft has not been taken into consideration because all of the arrangements have been employed to reduce the value of air resistance of only the head or the shaft.

That is, it takes too long a time to form grooves in the surface of the overall body of the head in the arrangement shown in FIG. 27, in which a multiplicity of the thin grooves are formed in the entire surface of the head. The same is true of the arrangement as shown in FIG. 28, in which the grooves are formed in the entire surface of the head in such a manner that the grooves extend substantially parallel to the face of the head. In a structure such as that shown in FIG. 29, in which the pile is formed on the entire surface of the head, a problem arises in that the pile will be separated when it is used. In a shaft having the linear projection, tripping wires forming the linear projections must be wound around the surface of the shaft. Therefore, it takes to long a time to fasten the wires, since the wires must be fastened straight with respect to the axis of the shaft at the time of manufacturing the shaft.

Furthermore, an increase in the drag, due to the generation of an eddy current, the rotational direction of which is in substantially the same as the swinging direction, has not been taken into consideration. Therefore, the value of air resistance cannot satisfactorily be reduced.

Furthermore, the conventional golf clubs have not been arranged to meet a necessity which arises in that the state of the surface treatment for reducing the value of air resistance must be different for different golfers, since the head speeds of golf clubs used by the different golfers are different from one another. Therefore, the air resistance generated when the golf club is swung cannot be reduced as desired.

SUMMARY OF THE INVENTION

Accordingly, an object of the present invention is to provide a golf club capable of reducing air resistance generated when the golf club is swung in comparison to the conventional golf club so that the head speed is raised and the shooting distance can thereby be lengthened while revealing a satisfactory workability.

According to one aspect of the present invention, there is provided a golf club composed of a head, a shaft, a grip and the like. The golf club include: a roughened surface portion capable of reducing the value of air resistance by forming a turbulent boundary layer around the head when the golf club is swung, the roughened surface portion being formed in a neck portion, a socket portion of the head and at least a portion of the shaft adjacent to the head.

According to another aspect of the present invention, there is provided a golf club comprising: a roughened surface portion capable of reducing the value of air resistance by forming a turbulent boundary layer around the head when the golf club is swung, the roughened surface portion being formed annularly in a peripheral portion of a face of the head.

According to another aspect of the present invention, there is provided a golf club comprising: a roughened surface portion capable of reducing the value of air resistance by forming a turbulent boundary layer around the head when the golf club is swung and formed in a neck portion, a socket portion of the head and at least a portion of the shaft adjacent to the head, the roughened surface portion being further formed annularly in a peripheral portion of a face of the head.

According to another aspect of the present invention, there is provided a golf club having a head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; and the shape of the head is substantially rectangular.

According to another aspect of the present invention, there is provided a golf club having a head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; the shape of the head is substantially rectangular; and there is formed a roughened surface portion, capable of reducing the value of air resistance by forming a turbulent boundary layer around the head when the golf club is swung, on a neck portion, a socket portion of the head and at least a portion of the shaft adjacent to the head.

According to another aspect of the present invention, there is provided a golf club having a head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; the shape of the head is substantially rectangular; and roughened surface portion, capable of reducing the value of air resistance by forming a turbulent boundary layer around the head when the golf club is swung, is annularly formed in the peripheral portion of the face of the head.

According to another aspect of the present invention, there is provided a golf club having a head capable of reducing the value of air resistance by forming a turbulent boundary layer around the head when the golf club is swung. The head is arranged in such a manner that: the ratio of the width from a heel portion to a toe portion, the thickness of a sole portion to a crown portion and the depth from a face portion to a back portion is substantially 2:1:1.6; the shape of the head is substantially rectangular; and a roughened surface portion capable of reducing the value of air resistance by forming a turbulent boundary layer around the head when the golf club is swung is formed in a neck portion, a socket portion of the head and at least a portion of the shaft adjacent to the head. The roughened surface portion is further formed annularly in a peripheral portion of a face of the head.

According to another aspect of the present invention, there is provided a golf club comprising a head capable of reducing the value of air resistance by forming a turbulent boundary layer around the head when the golf club is swung and arranged in such a manner that: its neck portion has a length of 40 mm to 75 mm from the terminal end of the heel portion to a hosel top end portion; the cross sectional area of the neck portion is in the form of a substantially elliptic shape or a streamline shape; and a roughened surface portion capable of reducing the value of air resistance by forming a turbulent boundary layer around the head when the golf club is swung is formed in a neck portion, a socket portion of the head and at least a portion of the shaft adjacent to the head.

According to another aspect of the present invention, there is provided a golf club having a head capable of reducing the value of air resistance by forming a turbulent boundary layer around the head when the golf club is swung and arranged in such a manner that: its neck portion has a length of 40 mm to 75 mm from the terminal end of the heel portion to a hosel top end portion; the cross sectional area of the neck portion is in the form of a substantially elliptic shape or a streamline shape; and a roughened surface portion, capable of reducing the value of air resistance by forming a turbulent boundary layer around the head when the golf club is swung, is annularly formed in a peripheral portion of a face of the head.

According to another aspect of the present invention, there is provided a golf club having a head capable of reducing the value of air resistance by forming a turbulent boundary layer around the head when the golf club is swung and arranged in such a manner that: its neck portion has a length of 40 mm to 75 mm from the terminal end of the heel portion to a hosel top end portion; the cross sectional area of the neck portion is in the form of a substantially elliptic shape or a streamline shape; and a roughened surface portion, capable of reducing the value of air resistance by forming a turbulent boundary layer around the head when the golf club is swung is formed in a neck portion, a socket portion of the head and at least a portion of the shaft adjacent to the head, the roughened surface portion being further formed annularly in a peripheral portion of a face of the head.

According to another aspect of the present invention, there is provided a golf club having a head capable of reducing the value of air resistance by forming a turbulent boundary layer around the head when the golf club is swung and arranged in such a manner that: the ratio of the width from a heel portion to a tow portion, the thickness of a sole portion to a crown portion and the depth from a face portion to a back portion is substantially 2:1:1.6; the shape of the head is in a substantially rectangular shape, its neck portion has a length of 40 mm to 75 mm from the terminal end of the heel portion to a hosel top end portion; and the cross sectional area of the neck portion is in the form of a substantially elliptic shape or a streamline shape.

According to another aspect of the present invention, there is provided a golf club comprising the head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; the shape of the head is in a substantially rectangular shape; its neck portion has a length of 40 mm to 75 mm from the terminal end of the heel portion to a hosel top end portion; the cross sectional area of the neck portion is in the form of a substantially elliptic shape or a streamline shape; and there is formed a roughened surface portion, capable of reducing the value of air resistance by forming a turbulent boundary layer around the head when the golf club is swung, in a neck portion, a socket portion of the head and at least a portion of the shaft adjacent to the head.

According to another aspect of the present invention, there is provided a golf club having a head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; the shape of the head is in a substantially rectangular shape; its neck portion has a length of 40 mm to 75 mm from the terminal end of the heel portion to a hosel top end portion; the cross sectional area of the neck portion is in the form of a substantially elliptic shape or a streamline shape; and a roughened surface portion, capable of reducing the value of air resistance by forming a turbulent boundary layer around the head when the golf club is swung, is annularly formed in a peripheral portion of a face of the head.

According to another aspect of the present invention, there is provided a golf club having a head capable of reducing the value of air resistance by forming a turbulent boundary layer around the head when the golf club is swung and arranged in such a manner that: the ratio of the width from a heel portion to a toe portion, the thickness of a sole portion to a crown portion and the depth from a face portion to a back portion is substantially 2:1:1.6; the shape of the head is substantially rectangular; its neck portion has a length of 40 mm to 75 mm from the terminal end of the heel portion to a hosel top end portion; the cross sectional area of the neck portion is in the form of a substantially elliptic shape or a streamline shape; and a roughened surface portion, capable of reducing the value of air resistance by forming a turbulent boundary layer around the head when the golf club is swung, is formed in a neck portion, a socket portion of the head and at least a portion of the shaft adjacent to the head, the roughened surface portion being further formed annularly in a peripheral portion of a face of the head.

The golf club may be arranged in such a manner that the ratio of the width from a heel portion to a toe portion, the thickness of a sole portion to a crown portion and the depth from a face portion to a back portion is substantially 2:1:1.6 and its shape is substantially rectangular and is further arranged in such a manner that a curvature radius of a top edge portion is 60 to 80 mm, a curvature radius of a crown portion is 90 to 110 mm, and a curvature radius of a sole portion is 140 to 200 mm.

It is preferable that the width of the annular roughened surface portion formed in the peripheral portion of the face of the head is at least 10 mm or more and 30 mm or less.

It is preferable that the surface roughness of the roughened surface portion formed in each of the head and the shaft is 50μ or more and 300μ or less.

It is preferable that the surface roughness of the roughened surface portion formed in each of the head and the shaft is 80μ or more and 200μ or less.

It is preferable that the surface roughness of the roughened surface portion formed in each of the head and the shaft is substantially 100μ.

It is preferable that the surface roughness of the roughened surface portion formed in each of the head and the shaft is gradually changed from rough to fine or fine to rough.

It is preferable that the roughened surface portion formed in each of the head and the shaft is made of a granular material the surface roughness of which is 50μ or more.

It is preferable that the roughened surface portion formed in each of the head and the shaft is manufactured by integrally forming a granular material by using a synthetic resin or coating.

It is preferable that the roughened surface portion formed in each of the head and the shaft is formed by a roughening process such as plating, ion plating, CVD, PVD, honing, etching, dimple forming or the like.

As described above, according to the present invention, the head or the neck portion of the head having an ordinary shape, a rectangular shape or a similar shape is arranged to have an elliptical or streamlined shape. Furthermore, a roughened surface portion is formed on the surface of the neck portion, the socket portion, the peripheral portion of the face and/or the portion of the shaft adjacent to the head. The roughened surface portion is made of granular material having a roughness of about 100μ and is formed to be gradually changed. As a result, the value of air resistance can be reduced and the head speed can thereby be raised.

A variety of experiments have been carried out, resulting conditions, with which the value of air resistance of a golf club can be reduced, have been found.

According to the conventional disclosure of Japanese Laid-Open Patent Publication No. 62-176469, a description has been made that the value of air resistance increases in proportion to an increase in the head speed in a range of head speeds of the golf club swung by a human. However, the inventors found a fact, from experiments, that the value of air resistance is reduced and a limit is present in the surface roughness which will generate the turbulent boundary layer.

FIG. 25 illustrates results of a wind tunnel experiment subjected to a roughened surface portion (expressed by symbol ••) according to the present invention and formed, together with a coating by, applying glass beads having a diameter of about 50μ to the entire surface of the head. Another roughened surface portion (expressed by symbol Δ) according to the present invention is formed by applying glass beads which have a particle size of about 100μ to the periphery portion of the face of the head so as to form an annular shape of about 10 mm. Furthermore, a conventional head (expressed by symbol O) having a smooth surface was also subjected to the experiment.

As can be seen from FIG. 25, the roughened surface portion formed, together with a coating by, applying glass beads having a diameter of about 50μ to the entire surface of the head reduced the value of air resistance by about 18% in comparison to the conventional smooth head even if the wind speed was raised from about 100 km/h to about 160 km/h. Furthermore, the roughened surface portion formed by applying glass beads which have a particle size of about 100μ to the periphery portion of the face of the head so that an annular shape of about 10 mm was formed red. d the same by about 33%.

Although the roughened surface portion can be formed on the entire surface of the head, the above-described arrangement, made in such a manner that the annular roughened surface portion having width of 10 mm to 30 mm is formed in the periphery portion of the head, will eliminate complicated manufacturing work and thereby improve the manufacturing efficiency. Furthermore, the quantity of the necessary synthetic resin and the coating can be reduced, causing an advantage in terms of the overall cost to be obtained. Furthermore, if the annular roughened surface portion formed in the peripheral portion of the face is made in parallel to the outer surface of the face, it can be used as a reference at the time of addressing a ball.

The surface treatment for generating the turbulent boundary layer so as to reduce the air resistance must be applied to the above-described portions under a plurality of specific conditions.

Furthermore, since the conventional head shape has not been arranged to reduce the increase in the undesirable drag due to the generation of an eddy current, the rotational axial direction of which is in the direction of a hit ball, the air resistance has not been satisfactorily reduced. That is, the conventional head, having a round shape has a problem in that the generation of an undesirable eddy current, due to a collision of air flows which have passed via the tow portion, is caused and the heel portion. However, the present invention is arranged in such a manner that the shape of the head, when viewed from an upper portion, is made to be substantially rectangular. Furthermore; the sole portion is also made to be in the form of a rectangular shape similar to the shape of the main body of the head. In consequence, a collision of the air flows can be eliminated and an increase in an drag due to the generation of the eddy current can thereby be prevented.

At this time, the shape of the body of the head is made substantially rectangular and the cross sectional shape of each of the portions from the face to the back portion is arranged to have the above-described curvature radius. In consequence, the collision of the air flows can be eliminated and the generation of the eddy current is prevented so that the value of air resistance is reduced.

As a result of experiments, it has been found that the value of air resistance can be considerably reduced in accordance with an increase in the head speed by making the cross sectional shape of the shaft elliptical and by forming a roughened surface portion on the surface of the shaft as compared to a conventional shaft. However, the present golf rule prohibits the use of shafts except for the shafts having a circular cross sectional shape. As a result of experiments, the inventors found that it is preferable to employ the above-described principle of the elliptical cross sectional shaft in the neck portion and to make length of the neck portion be about 40 mm to 75 mm from the end of the heel portion to the top end portion of the, taking in consideration the front projection area, the position of the center of gravity and securing of the contact area with the shaft.

Although a lack is present in the sequence, a shaft has a different Reynolds number from that of the head since it has a small size with respect to the head. Therefore, the shaft acts in a different manner from the action of the head as shown in FIG. 26.

That is, as shown in FIG. 26, the value of air resistance of the shaft is enlarged in accordance with the increase in the head speed. Furthermore, if the surface roughness is 50μ or less, the rougher the surface is rough, the more the resistance is enlarged at the same speed in comparison to a smooth shaft. If the surface roughness is about 100μ, the action of the shaft is rapidly changed in such a manner that the value of air resistance is excessively reduced in accordance with an increase in the head speed.

Since the golf swing is a substantially circular motion, the speed is, actually different in different portions of the shaft.

That is, the portion of the shaft adjacent to the head moves at a high speed, while the portion positioned away from the same moves at a low speed. A golfer who swings a driver at a head speed of about 160 km/h (corresponding to a non-professional long hitter) swings the same at a speed of 130 km/h displayed at a position of 200 mm from the end of the heel portion. Therefore, the value of air resistance can be reduced, due to a roughened surface portion formed in the portion from the above-described position toward the head.

On the other hand, the value of air resistance can be reduced by smoothing the surface of the portion adjacent to the grip.

Therefore, long clubs such as a driver, a long iron or the like in one set of golf clubs respectively have a large portion which moves at a high speed faster than 130 km/h. As a result, the value of air resistance can be reduced by lengthening the roughened surface portion on the surface of the portion adjacent to the head.

On the contrary, since a short iron does not include substantial portion which moves at a speed exceeding 130 km/h, the value of air resistance can be reduced by making the surface smooth as it is. Therefore, it is preferable to arrange the various golf clubs to have the most suitable structures which are gradually changed in accordance with the characteristics of the golf clubs.

When a club is selected by a golfer, a shaft having the most suitable hardness is selected in accordance with the head speed. It is preferable to previously form the above-described roughened surface portion for a length from the head to the grip end of the club in a manner to be described later in accordance with the head speed which is previously predicted.

According to the present invention, a variety of golf clubs capable of reducing the value of air resistance in comparison to the conventional golf club can be arranged depending upon data obtained from the above-described experiments.

Other and further objects, features and advantages of the invention will be appear more fully from the following description.

BRIEF DESCRIPTION OF THE DRAWINGS

FIG. 7-B is a cross sectional view from the face to the back portion of FIG. 7-A;

DESCRIPTION OF THE PREFERRED EMBODIMENTS

Figure 1:
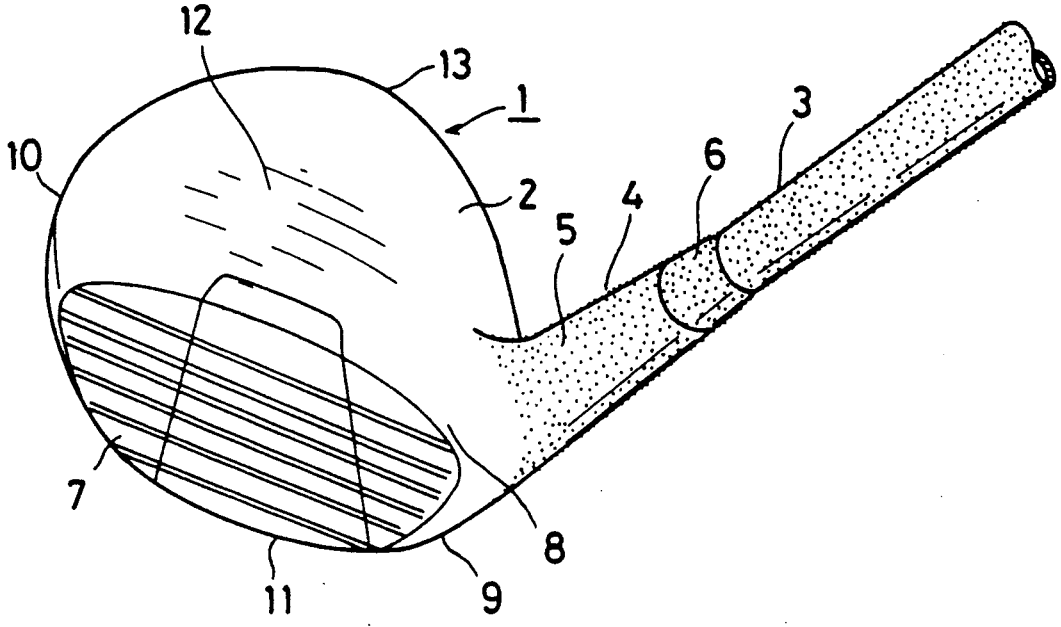
FIG. 1 is a perspective view which illustrates a golf club according to the present invention.
Figure 2:
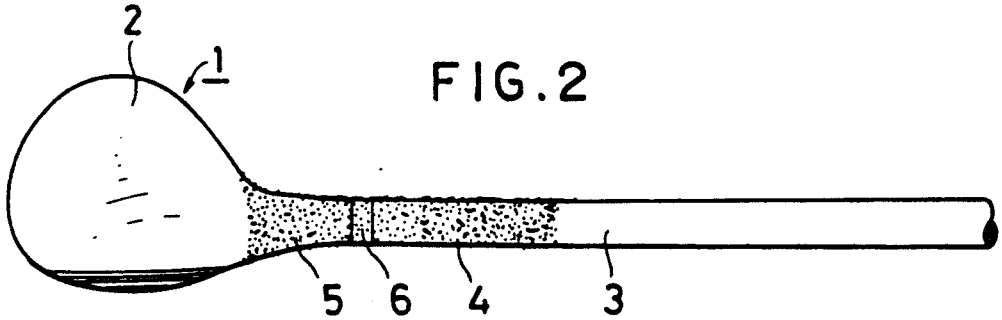
FIGS. 2 to 4 are plan views which respectively illustrate the golf club according to the present invention.
Figure 3:
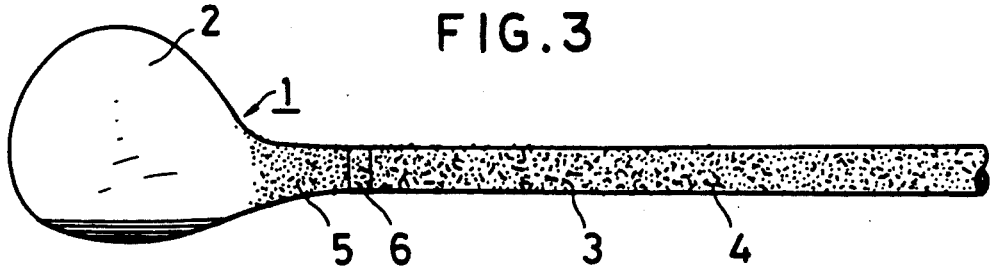

Preferred embodiments of a golf club according to the present invention will now be described with reference to the drawings.

As shown in FIGS. 1 to 4, a golf club 1 composed of a head 2, a shaft 3, a grip and the like has a roughened surface portion 4 in a neck portion 5 of the head 2 and a socket portion 6 in order to reduce the value of air resistance by forming a turbulent boundary layer around the head 2 when the golf club 1 is swung, the roughened surface portion 4 being further formed in at least a portion of the shaft 3 adjacent to the head 2.

The structure of this embodiment will further be described referring to Table 1.

TABLE 1

| Head Speed and Dimensions of Roughened surface portion | | | | | | | |
|---|---|---|---|---|---|---|---|
| Head Speed of | | Length of surface roughened portion on the shaft and the neck from heel portion (mm) | | | | | |
| Driver | Type of Golfers | 1W | 3W | 5W | 31 | 61 | 91 |
| 100 km/h | Female player of insufficient power | 0 | 0 | 0 | 0 | 0 | 0 |
| 120 km/h | Ordinary female and male senior players | 0 | 0 | 0 | 0 | 0 | 0 |
| 140 km/h | Ordinary male and female player who can swing the club at high speed | 80 | 55 | 30 | 0 | 0 | 0 |
| 160 km/h | Male player who can swing the club at high speed | 200 | 175 | 150 | 90 | 50 | 10 |
| 180 km/h | Male professional player | 300 | 275 | 250 | 190 | 150 | 110 |
| 200 km/h | Male professional player who can swing the club club at extremely high speed | 380 | 355 | 330 | 270 | 230 | 190 |

That is, it is preferable for the length of the roughened surface portion of the each of wood clubs (driver 1 W to #5-wood club 5 W) to be 0 mm to 380 mm when measured from the heel portion, the wood clubs being adapted to golfers which are respectively capable of swinging the wood club at speeds of 100 km/h to 200 km/h which are values calculated in terms of the head speed of the driver.

Furthermore, it is also preferable for the length of the roughened surface portion of each of the iron clubs (#3 iron I3 to #9 iron I9) to be 0 mm to 270 mm when measured from the heel portion.

Figure 5:
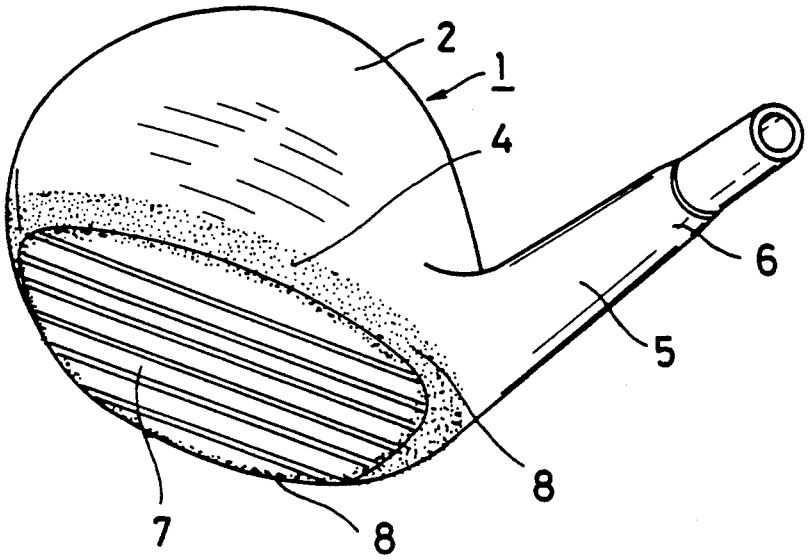
FIGS. 5 to 22 are perspective views which respectively illustrate the golf club according to the present invention.

The golf club 1 shown in FIG. 5 is arranged in such a manner that the roughened surface portion 4 is annularly formed in a peripheral portion 8 of the face of the head 2 so that the value of air resistance is reduced due to a turbulent boundary layer formed around the head 2 when the golf club 1 is swung.

As a consequence, a significant effect can be obtained in that the value of air resistance is reduced by about 33% in comparison to a conventional golf club which has a smooth entire surface.

Figure 6:
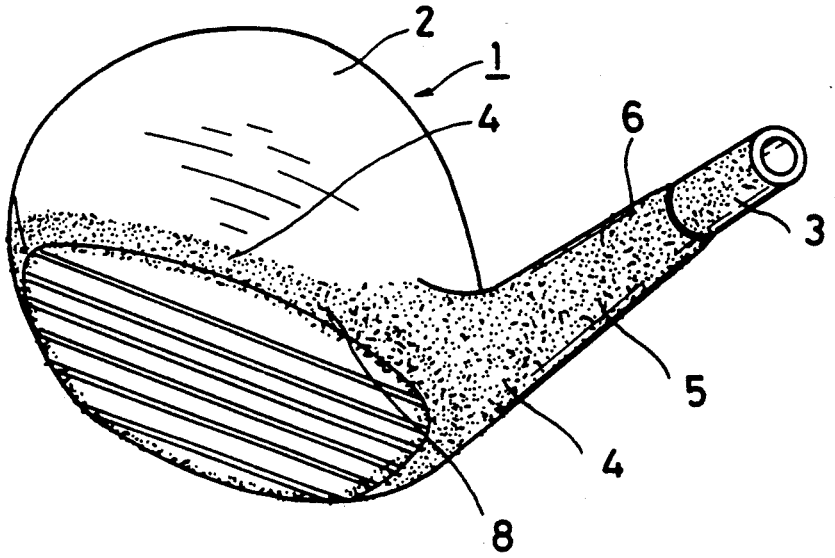

The golf club 1 shown in FIG. 6 is arranged in such a manner that the roughened surface portion 4 is formed in the neck portion 5 of the head 2, the socket portion 6, at least the portion of the shaft 3 which is adjacent to the head 2 and the peripheral portion 8 of the face of the head 2 in the form of an annular portion so that the value of air resistance is reduced due to a turbulent boundary layer formed around the head 2 when the golf club 1 is swung.

As a result, the value of air resistance can be reduced at a head speed of 130 km/h or more due to the existence of the roughened surface portion formed in the shaft and the neck portion. Furthermore, since the annular roughened surface portion is also formed in the periphery of the face of the head, the value of air resistance can further be reduced due to a synergetic effect of the above-described roughened surface portions.

For example, the air resistance coefficient (Cx) can be improved from 0.64 to 0.42 in comparison to a conventional persimmon head having a smooth entire surface.

Figure 7A:
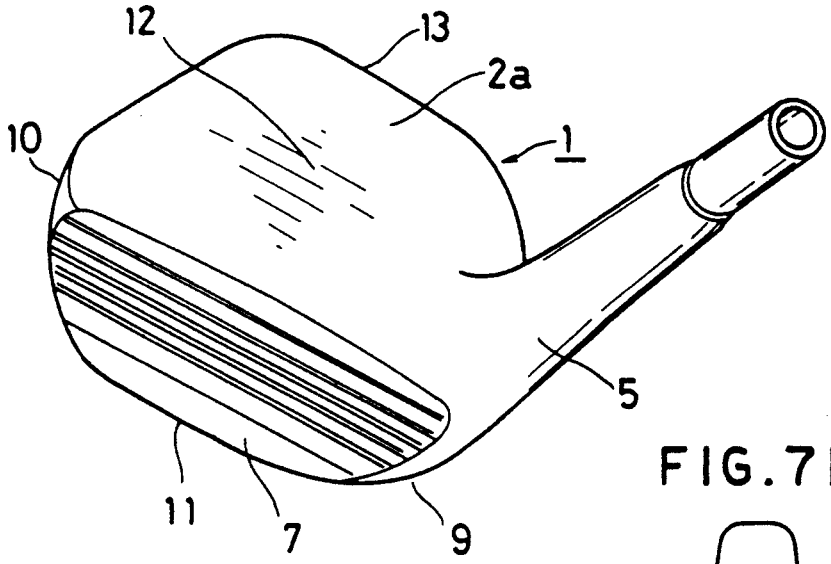
Figure 7B:
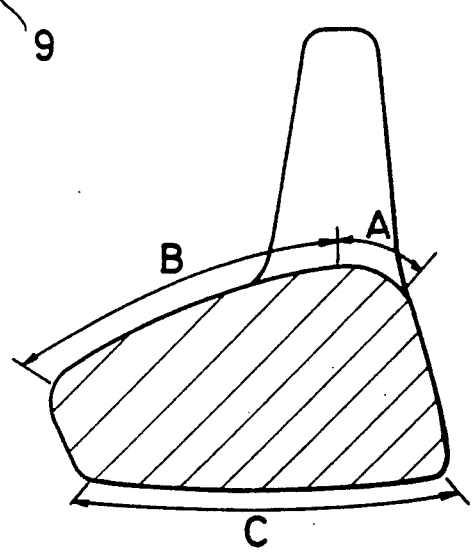

Furthermore, in order to reduce the value of air resistance by forming a turbulent boundary layer around the head 2*a* when the golf club 1 is swung, another structure of the golf club 1 may be employed as shown in FIG. 7-A in which the ratio of the width from a heel portion 9 to a toe portion 10, the thickness of a sole portion 11 to a crown portion 12 and the depth from a face portion 7 to a back portion 13 is substantially 2:1:1.6. The golf club 1 is further arranged in such a manner that its head 2*a* is in the form of a substantially rectangular shape.

As a result of the structure arranged in such a manner that the shape of the head is in the form of a substantially rectangular shape when viewed from the upper portion, undesirable eddy currents, which can be generated due to the collision of air flows around the head, can be reduced, causing the value of air resistance to be reduced. Furthermore, since the inertial moment of the head can be enlarged, the direction of a hit ball can be satisfactorily controlled.

It is preferable to specifically arrange the head in such a manner that the width from the heel portion to the toe portion is about 87 mm, the thickness from the sole portion to the crown portion is about 43 mm and the depth from the face portion to the back portion is about 70 mm.

Furthermore, if the cross sectional shape of the substantially rectangular head according to the present invention is, as shown in FIG. 7-B, arranged in such a manner that curvature radius A of the top edge portion is 60 to 80 mm, curvature radius B of the crown portion is 90 to 110 mm and curvature radius C of the sole portion is 140 to 200 mm, the value of air resistance can be reduced.

Figure 8:
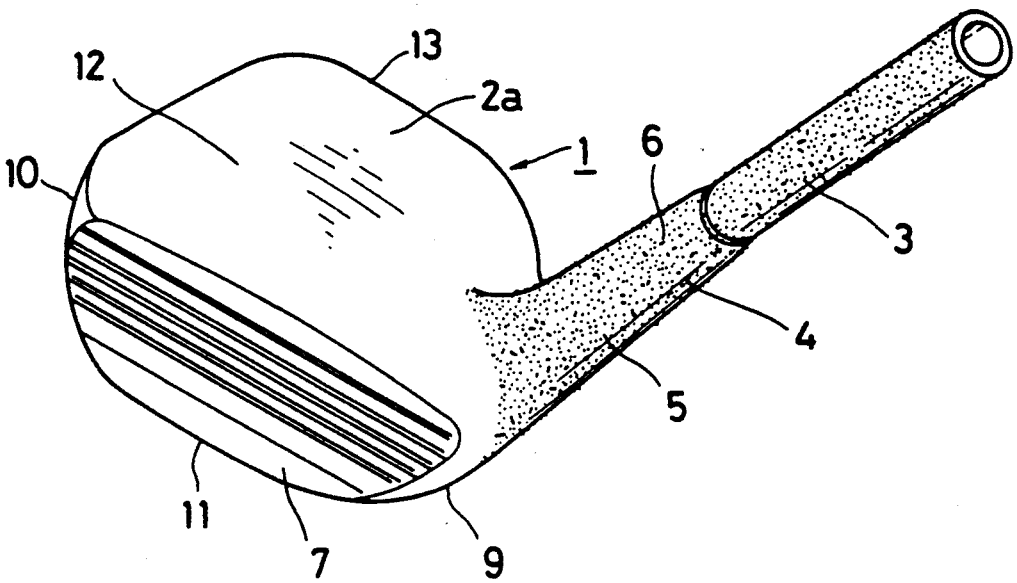

As shown in FIG. 8, in order to reduce the value of air resistance of the head 2*a* when the golf club 1 is swung, another structure of the golf club 1 may be employed in which the ratio of the width from the heel portion 9 to the toe portion 10, the thickness of the sole portion 11 to the crown portion 12 and the depth from the face portion 7 to the back portion 13 is substantially 2:1:1.6. The golf club 1 is further arranged in such a manner that its head 2*a* is in the form of a substantially rectangular shape. In addition, the golf club 1 has the roughened surface portion 4 in the neck portion 5 of the head 2*a*, the socket portion 6 and in at least a portion of the shaft 3 adjacent to the head 2 so that the value of air resistance is reduced due to a turbulent boundary layer formed around the head 2*a* when the golf club 1 is swung.

As a result, the synergetic effect of the roughened surface of the shaft and the neck portion and the rectangular shape of the head will reduce the value of air resistance. In consequence, the head speed can be raised, and the inertial moment of the head can be enlarged. Therefore, the direction of a hit ball can be satisfactorily controlled. In addition, the ball shooting range can be lengthened.

Figure 9:
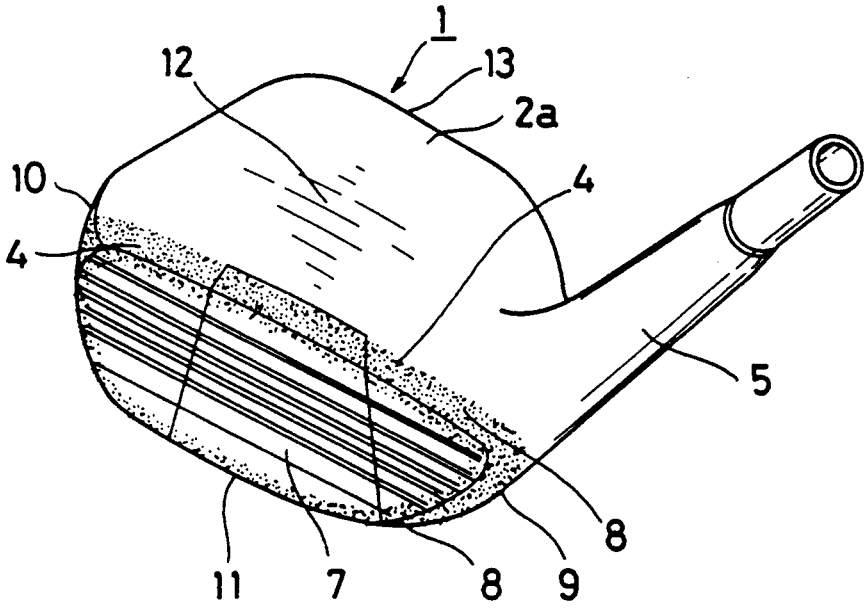

The golf club 1 shown in FIG. 9 is arranged in order to reduce the value of air resistance by forming a turbulent boundary layer around the head 2*a* when the golf club 1 is swung, the golf club 1 being arranged in such a manner that the ratio of the width from the heel portion 9 to the toe portion 10, the thickness of the sole portion 11 to the crown portion 12 and the depth from the face portion 7 to the back portion 13 is substantially 2:1:1.6. The golf club 1 is further arranged in such a manner that its head 2*a* is in the form of a substantially rectangular shape. In addition, the golf club 1 has the roughened surface portion 4 to form an annular shape in the peripheral portion 8 of the face portion of the head 2*a* so that the value of air resistance is reduced due to a turbulent boundary layer formed around the head 2*a* when the golf club 1 is swung. As a result of the structure thus arranged, undesirable eddy currents, which can be generated due to the collision of air flows around the head, can be reduced. Furthermore, since the inertial moment of the head can be enlarged, the direction of a hit ball can be satisfactorily controlled. In addition, the annular roughened surface portion formed in the periphery of the face portion will create a turbulent boundary layer. Therefore, the value of air resistance can be reduced, causing the head speed to be raised.

Furthermore, if the shape of the substantially rectangular head is, as described above, arranged in such a manner that the curvature radius A of the top edge portion is 60 to 80 mm, the curvature radius B of the crown portion is 90 to 110 mm and the curvature radius C of the sole portion is 140 to 200 mm, the value of air resistance can further be reduced. According to this embodiment, the most significant effect can be obtained when the curvature radius of the top edge portion is made to be 60 to 80 mm, that of the crown portion is made to be about 100 mm and that of the sole portion is made to be about 160 mm.

Figure 10:
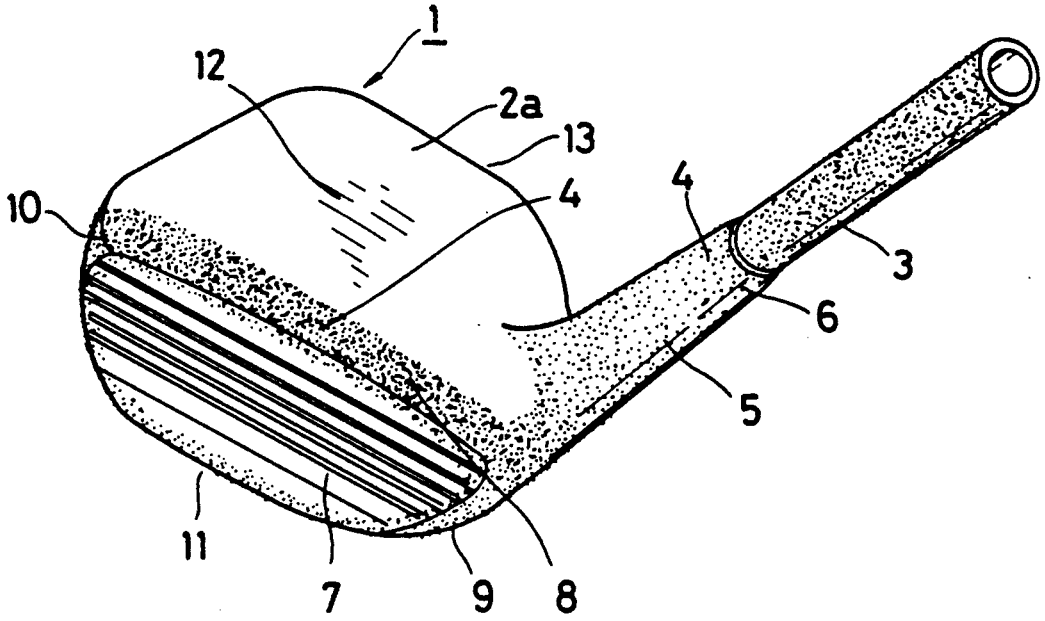

In order to reduce the value of air resistance when the golf club 1 is swung, the golf club 1 shown in FIG. 10 is arranged in such a manner that the ratio of the width from the heel portion 9 to the toe portion 10, the thickness of the sole portion 11 to the crown portion 12 and the depth from the face portion 7 to the back portion 13 is substantially 2:1:1.6. The golf club 1 is further arranged in such a manner that its head 2*a* is in the form of a substantially rectangular shape. In addition, the golf club 1 has a roughened surface portion 4 which creates the turbulent boundary layer around the head 2*a*, the roughened surface portion 4 being formed in the neck portion 5 of the head 2 and the socket portion 6. The roughened surface portion 4 is further formed to form an annular shape in at least the portion of the shaft 3 adjacent to the head 2.

As a result, the value of air resistance can be reduced as described above, and the inertial moment of the head can be enlarged. Therefore, the direction of a hit ball can be satisfactorily controlled. In addition, the ball shooting range can be lengthened.

Figure 11:
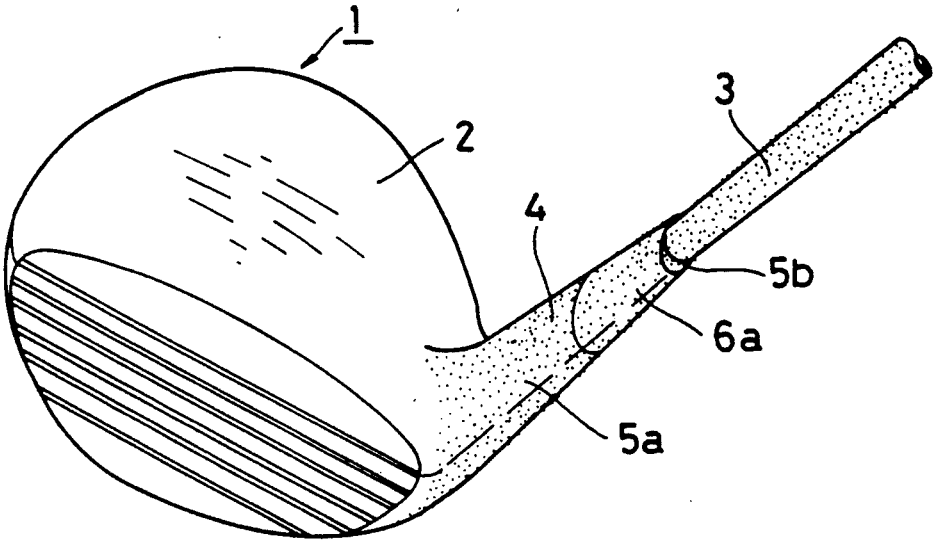

The golf club 1 shown in FIG. 11 is arranged so as to reduce the value of air resistance when the golf club 1 is swung, the golf club 1 having a head 2 which is arranged in such a manner that its neck portion 5*a* has a length of 40 mm to 75 mm from the terminal end of the heel portion to a hosel top end portion 5*b* and the cross sectional area of the neck portion 5*a* is in the form of a substantially elliptic shape or a streamline shape. Furthermore, in order to reduce the value of air resistance when the golf club 1 is swung by forming a turbulent boundary layer around the head 2, the roughened surface portion 4 is formed in the neck portion 5*a* of the head 2, the socket portion 6*a* and at least a portion of the shaft adjacent to the head 2.

As a result, since the length of the neck portion 5*a* is shortened and the cross sectional shape is made to be in the form of a substantially elliptic shape or a streamline shape, the value of air resistance can be reduced. In addition, the arrangement of the shortened neck portion will lower the center of gravity of the head. As a result, another effect can be obtained in that a hit ball can be driven further upwards.

Furthermore, since the length of the neck portion is shortened, the flexible length of the golf club can be lengthened. As a result, a hit ball can be driven upwards and the ball shooting range can be lengthened since the weight balance is shifted forwards.

In a case where the head is arranged as described above, it is preferable to make the shape of the socket portion, which is connected adjacent to the neck portion, to be in the substantially same shape so as to be integrally formed in order to reduce the value of air resistance.

Figure 12:
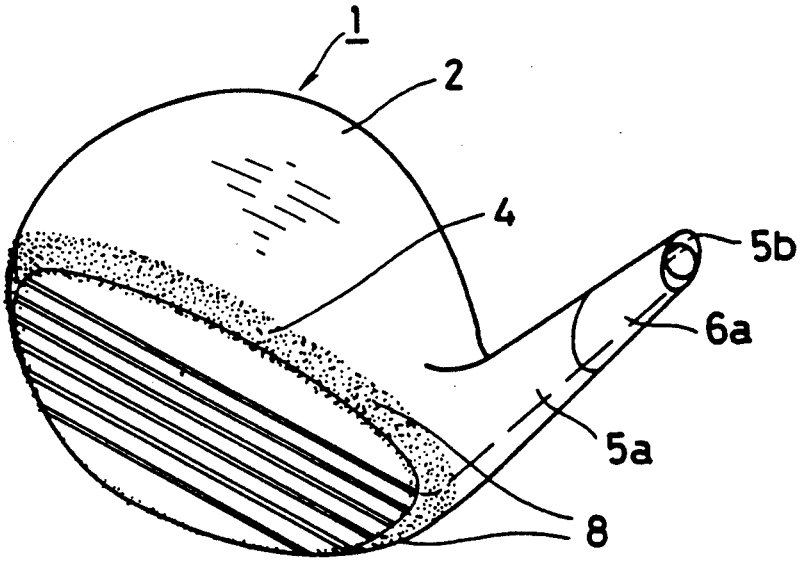

The golf club 1 shown in FIG. 12 is arranged so as to reduce the value of air resistance of the head 2 when the golf club 1 is swung, the golf club 1 having the head 2 which is arranged in such a manner that its neck portion 5*a* has a length of 40 mm to 75 mm from the terminal end of the heel portion to a hosel top end portion 5*b* and the cross sectional area of the neck portion 5*a* is in the form of a substantially elliptic shape or a streamline shape. Furthermore, in order to reduce the value of air resistance when the golf club 1 is swung by forming a turbulent boundary layer around the head 2, the roughened surface portion 4 is annularly formed in the peripheral portion 8 of the face of the head 2.

As a result of the structure thus arranged in such a manner that the length of the neck portion is shortened, the cross sectional shape of the same is in the form of a substantially elliptic shape or a streamline shape and the roughened surface portion is annularly formed in the periphery of the face, the value of air resistance can be reduced. Furthermore, the above-described effect due to the arrangement of shortening the length of the neck portion can similarly be obtained. As a result, the value of air resistance can further be reduced. Therefore, a golfer suffering from insufficient hitting power can easily hit a ball upwards. Therefore, the ball shooting range can be elongated.

Figure 13:
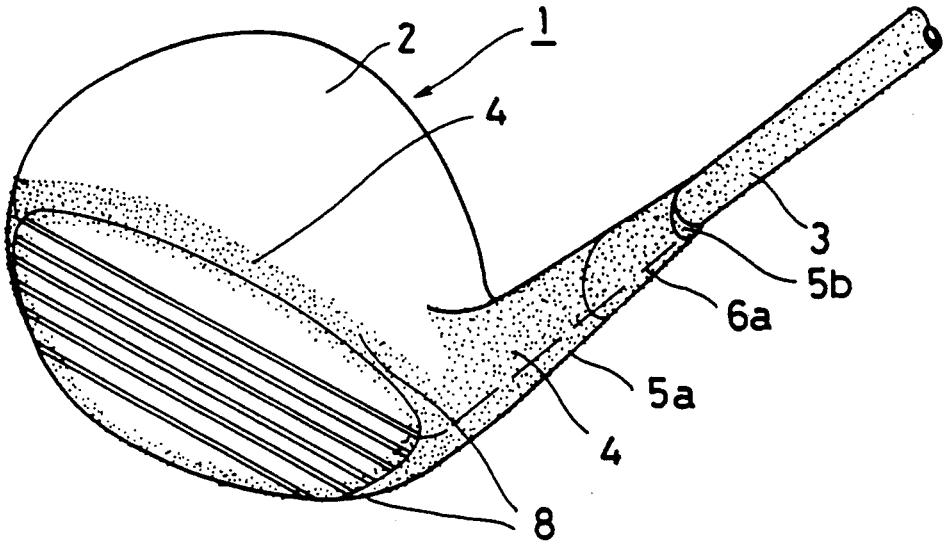
Figure 14:
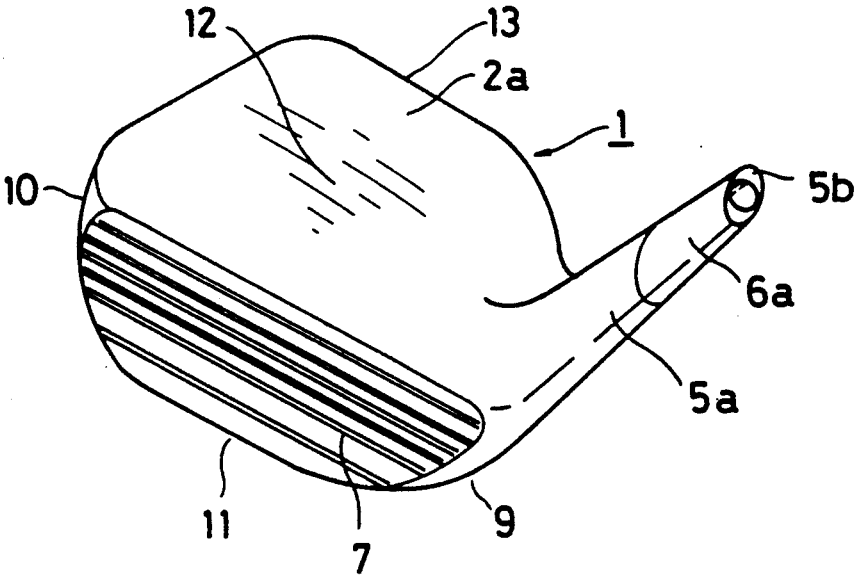

The golf club 1 shown in FIG. 13 is arranged so as to reduce the value of air resistance of the head 2 when the golf club 1 is swung. The golf club 1 having the head 2 is arranged in such a manner that its neck portion 5*a* has a length of 40 mm to 75 mm from the terminal end of the heel portion to a hosel top end portion 5*b* and the cross sectional area of the neck portion 5*a* is in the form of a substantially elliptic shape or a streamline shape. Furthermore, in order to reduce the value of air resistance when the golf club 1 is swung by forming a turbulent boundary layer around the head 2, the roughened surface portion 4 is formed in the neck portion 5*a*, the socket portion 6*a* and at least the portion of the shaft 3 adjacent to the head 2. In addition, the roughened surface portion 4 is annularly formed in the periphery 8 of the face of the head 2.

As a result of the structure thus arranged in such a manner that the length of the neck portion is shortened, the cross sectional shape of the same is in the form of a substantially elliptic shape or a streamline shape and the shape of the head is in the form of a substantially rectangular shape, the value of air resistance can be reduced. Furthermore, the above-described effect due to the arrangement of shortening the length of the neck portion can similarly be obtained.

Figure 15:
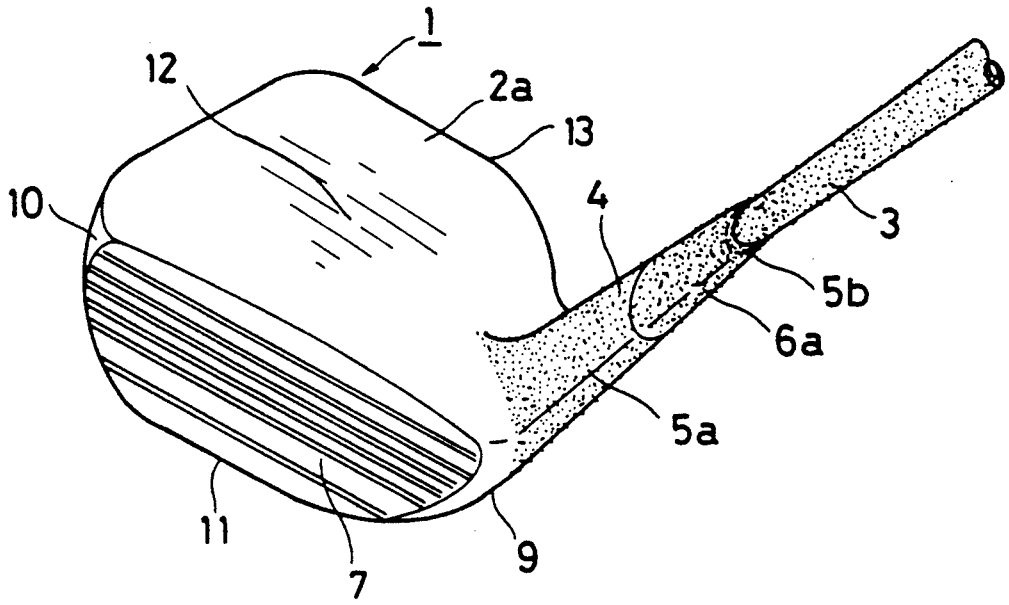

In order to reduce the value of air resistance when the golf club 1 is swung, another structure of the golf club 1 may be employed as shown in FIG. 15 in which the ratio of the width from a heel portion 9 to a toe portion 10, the thickness of a sole portion 11 to a crown portion 12 and the depth from a face portion 7 to a back portion 13 is substantially 2:1:1.6. The golf club 1 is further arranged in such a manner that its head 2*a* is in the form of a substantially rectangular shape, the neck portion 5*a* has a length of 40 mm to 75 mm from the terminal end of the heel portion to a hosel top end portion 5*b* and the cross sectional area of the neck portion 5*a* is in the form of a substantially elliptic shape or a streamline shape. Furthermore, in order to reduce the value of air resistance when the golf club 1 is swung by forming a turbulent boundary layer around the head 2, the roughened surface portion 4 is formed in the neck portion 5*a*, the socket portion 6*a* and at least the portion of the shaft 3 adjacent to the head 2.

As a result of the structure thus arranged in such a manner that the length of the neck portion is shortened, the cross sectional shape of the same is in the form of a substantially elliptic shape or a streamline shape, the shape of the head is in the form of a substantially rectangular shape and the roughened surface portion is formed in the portion of the shaft adjacent to the head, the value of air resistance can be reduced and the above-described effect due to the arrangement of shortening the length of the neck portion can similarly be obtained.

Figure 16:
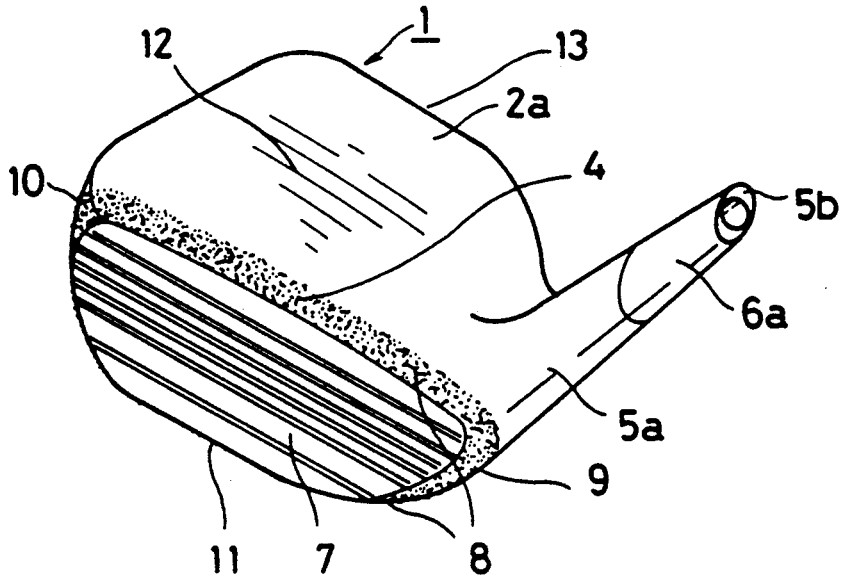

In order to reduce the value of air resistance when the golf club 1 is swung, another structure of the golf club 1 may be employed as shown in FIG. 16 in which the ratio of the width from a heel portion 9 to a tow portion 10, the thickness of a sole portion 11 to a crown portion 12 and the depth from a face portion 7 to a back portion 13 is substantially 2:1:1.6. The golf club 1 is further arranged in such a manner that its head 2*a* is in the form of a substantially rectangular shape, the neck portion 5*a* has a length of 40 mm to 75 mm from the terminal end of the heel portion to a hosel top end portion 5*b* and the cross sectional area of the neck portion 5*a* is in the form of a substantially elliptic shape or a streamline shape. Furthermore, in order to reduce the value of air resistance when the golf club 1 is swung by forming a turbulent boundary layer around the head 2, the roughened surface portion 4 is formed annularly in the peripheral portion 8 of the face of the head.

As a result of a structure thus arranged in such a manner that the length of the neck portion is shortened, the cross sectional shape of the same is in the form of a substantially elliptic shape or a streamline shape, the shape of the head is in the form of a substantially rectangular shape and the roughened surface portion is formed annularly in the periphery of the face, the value of air resistance can be reduced and the above-described effect due to the arrangement of shortening the length of the neck portion can similarly be obtained.

Figure 17:
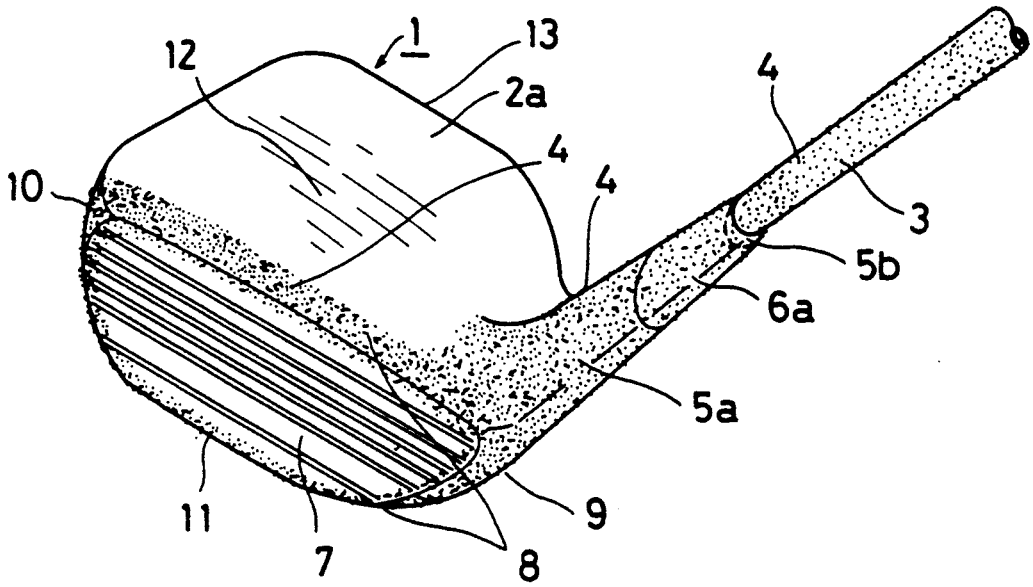
Figure 18:
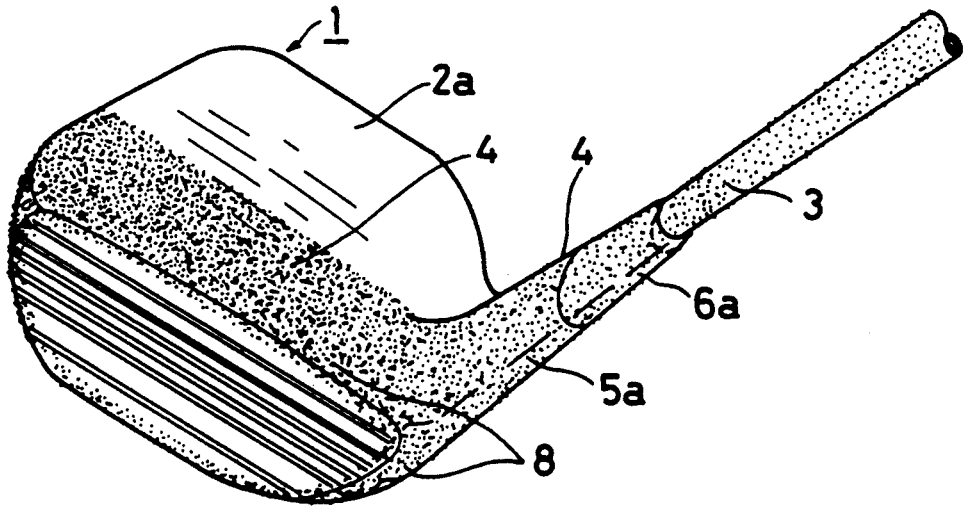

In order to reduce the value of air resistance when the golf club 1 is swung, another structure of the golf club 1 may be employed as shown in FIG. 17 in which the ratio of the width from a heel portion 9 to a toe portion 10, the thickness of a sole portion 11 to a crown portion 12 and the depth from a face portion 7 to a back portion 13 is substantially 2:1:1.6. The golf club 1 is further arranged in such a manner that its head 2*a* is in the form of a substantially rectangular shape, the neck portion 5*a* has a length of 40 mm to 75 mm from the terminal end of the heel portion to a hosel top end portion 5*b* and the cross sectional area of the neck portion 5*a* is in the form of a substantially elliptic shape or a stremline shape. Furthermore, in order to reduce the value of air resistance when the golf club 1 is swung by forming a turbulent boundary layer around the head 2, the roughened surface portion 4 is formed in the neck portion 5*a* of the head 2*a*, the socket portion 6*a* and at least the portion of the shaft 3 adjacent to the head 2*a*. The roughened surface portion 4 is further formed annularly in the peripheral portion 8 of the face of the head 2*a*.

The structure is arranged in such a manner that the length of the neck portion is shortened, the cross sectional shape of the same is in the form of a substantially elliptic shape or a streamline shape, the shape of the head is in the form of a substantially rectangular shape and the roughened surface portion is formed on the neck portion of the head, the socket portion and at least the portion of the shaft adjacent to the head, the roughened surface portion being further annularly formed in the periphery of the face. As a result, the value of air resistance can be reduced. Furthermore, the most significant effect can be obtained from the combinations according to the present invention. An air resistance coefficient (Cx) of about 0.4 can be realized with the head according to the present invention, in a significant effect being obtained in comparison to an air resistance coefficient (Cx) of about 0.6 to 0.7 realized with the conventional head. Therefore, a golf club having an air resistance value improved by about 33 to 43% and capable of lengthening the shooting range and satisfactorily controlling the direction of a hit ball can be provided.

The head, according to the present invention is arranged in such a manner that the ratio of the width from a heel portion 9 to a toe portion 10, the thickness of a sole portion 11 to a crown portion 12 and the depth from a face portion 7 to a back portion 13 is substantially 2:1:1.6 and the head 2a is in the form of a substantially rectangular shape, may be further arranged in such a manner that the curvature radius A of the top edge portion is 60 to 80 mm, the curvature radius B of the crown portion is 90 to 110 mm and curvature radius C of the sole portion is 140 to 200 mm. In this case, the value of air resistance can further efficiently be reduced.

As shown in FIGS. 5, 6, 9, 10, 12, 13, 16, 17 and 18, it is preferable to make the width of the annular roughened surface portion, formed in the periphery of the face of the head according to the present invention, be 10 mm or more and 30 mm or less. In this case, the value of air resistance can further efficiently be reduced in comparison to the conventional golf head. Furthermore, a significantly improved manufacturing efficiency can be realized.

The surface roughness of the roughened surface portion formed on the surface of each of the head and the shaft according to the present invention can be determined as desired. However, it is preferable to make the roughened surface portion range between 50μ and 300μ when the roughened surface portion is annularly formed in the periphery of the face of the head.

In the case where the roughened surface portion is formed on the surface of the shaft, it is preferable to make the surface roughness be about 100μ so as to effectively reduce the value of air resistance at a high head speed.

The surface roughness of the roughened surface portion may be made about 80μ to 200μ taking in consideration of the shape of the shaft or the like.

The above-described roughened surface portion formed on a surface of the head and that on a surface of the shaft may be arranged to have a common roughness of about 100μ in terms of reducing the value of air resistance as well as improving the manufacturing efficiency.

Figure 4:
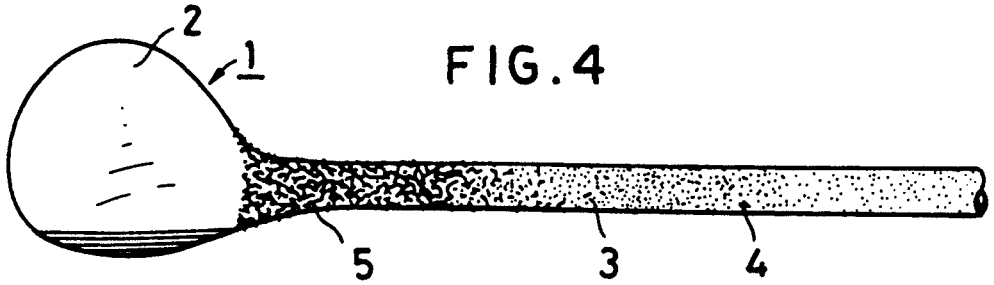

As shown in FIG. 4, the surface roughness of the roughened surface portion formed on the surface of the head and that formed on the surface of the shaft may be gradually changed from a rough degree to a fine degree in consideration of the circular motion performed by the shaft when it is swung by a golfer. In this case, the value of air resistance, which delicately changes depending upon the portions of the shaft, can be satisfactorily and smoothly reduced.

Figure 20:
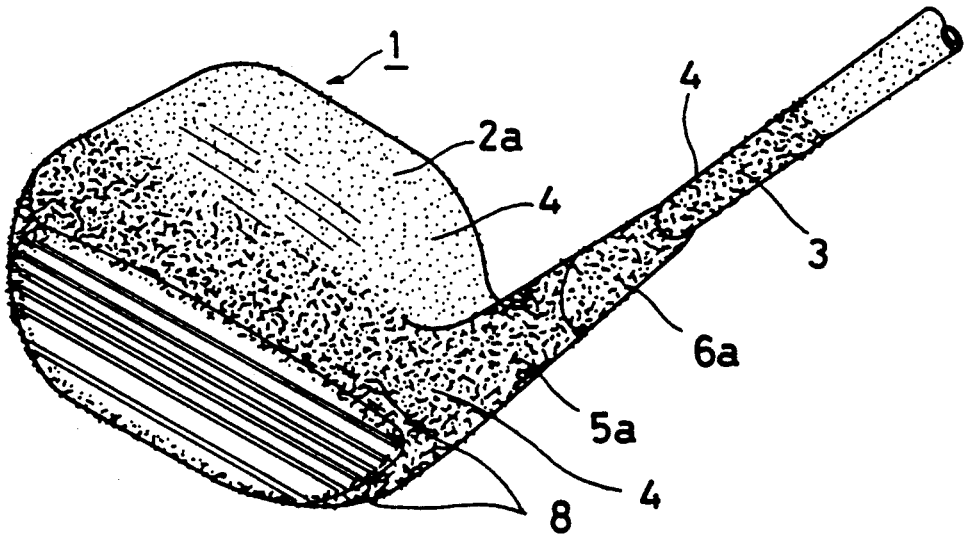

In addition, the roughened surface portion formed in the periphery of the face of the head may be, as shown in FIG. 20, arranged to be gradually changed from a rough annular portion to a fine surface portion, and the roughened surface portion may be formed in principle portions of the head if necessary.

Figure 19:
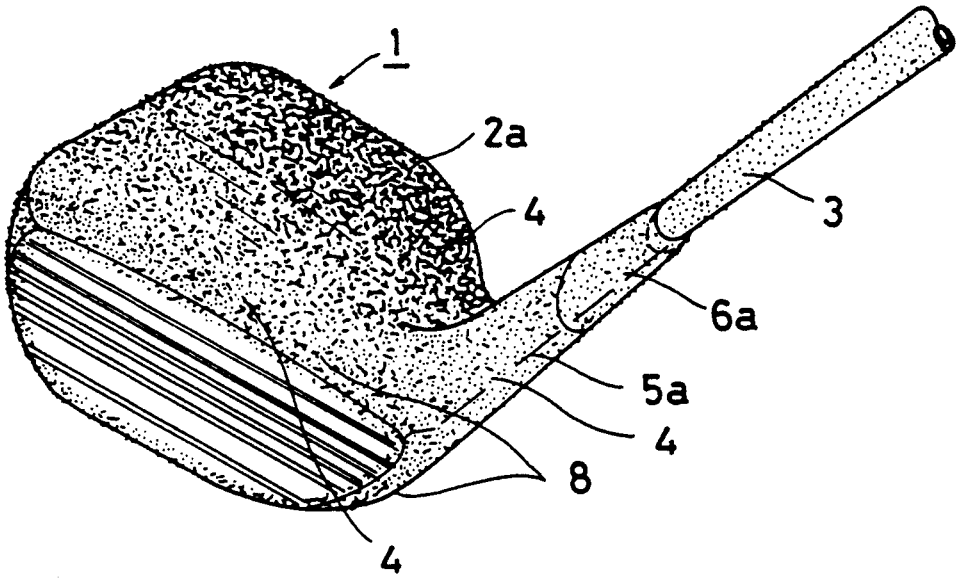

As shown in FIG. 19, another structure may be employed in which a finely-roughened annular portion is gradually changed to a rough surface formed in the principal portion of the head. A selection can be made from the above-described patterns in accordance with the determined combination of the shape of the head, that of the shaft and the material for making the roughened surface portion.

It is preferable to use a granular material, the roughness of which is 50μ or more, to form the roughened surface portion formed in the head and the shaft according to the present invention.

The granular material is exemplified by inorganic or mineral material such as: glass beads, ceramic, corborundum, microballons, alumina, garnet, sand or the like; a metal material such as aluminum, iron, titanium, copper or the like; plastic such as nylon, ABS, polyethylene or the like; and a synthetic or natural organic material such as rubber, cork, corn, sawdust or the like. The roughened surface portion of the head and the shaft according to the present invention can be formed in such a manner that any of the above-described granular materials is allowed to adhere, applied or coated by using a synthetic resin or coating.

As a result, the roughened surface portion may be formed in such a manner that the above-described granular material is embedded in the synthetic resin or the coating. As an alternative to this, the roughened surface portion may be formed in such a manner that the surface of the synthetic resin or the coating is covered with the granular material so as to embed a portion and allow the other portions to appear.

The roughened surface portion of the head and the shaft according to the present invention can be formed by plating, ion plating, CVD (Chemical Vacuum Deposition), PVD (physical Vacuum Deposition), honing, etching or dimple forming.

For example, in a case where plating is performed, electric plating, chemical plating or electroless plating may be employed so as to form a matted surface, resulting in a similar effect.

Figure 21:
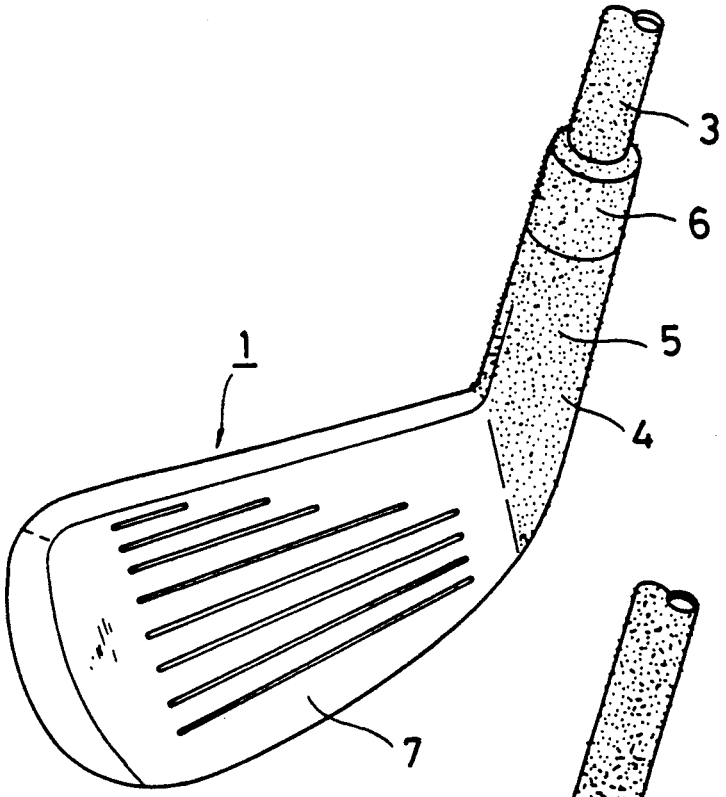
Figure 22:
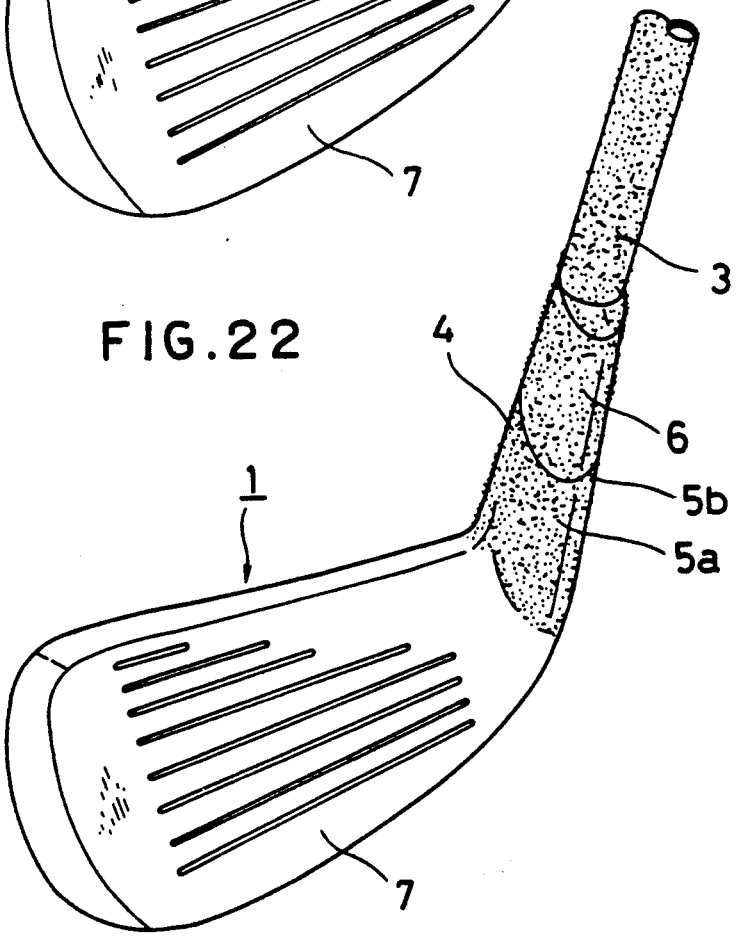

The structure of a golf club according to the present invention may, also, be employed in an iron club as shown in FIGS. 21 and 22.

The head of the golf club according to the present invention may be made of wood, metal, plastic, FRB, FRM or the like.

The shaft of the same may comprise an ordinary metal or FRP shaft or the like.

The following effects can be obtained from the golf club according to the present invention.

Figure 23:
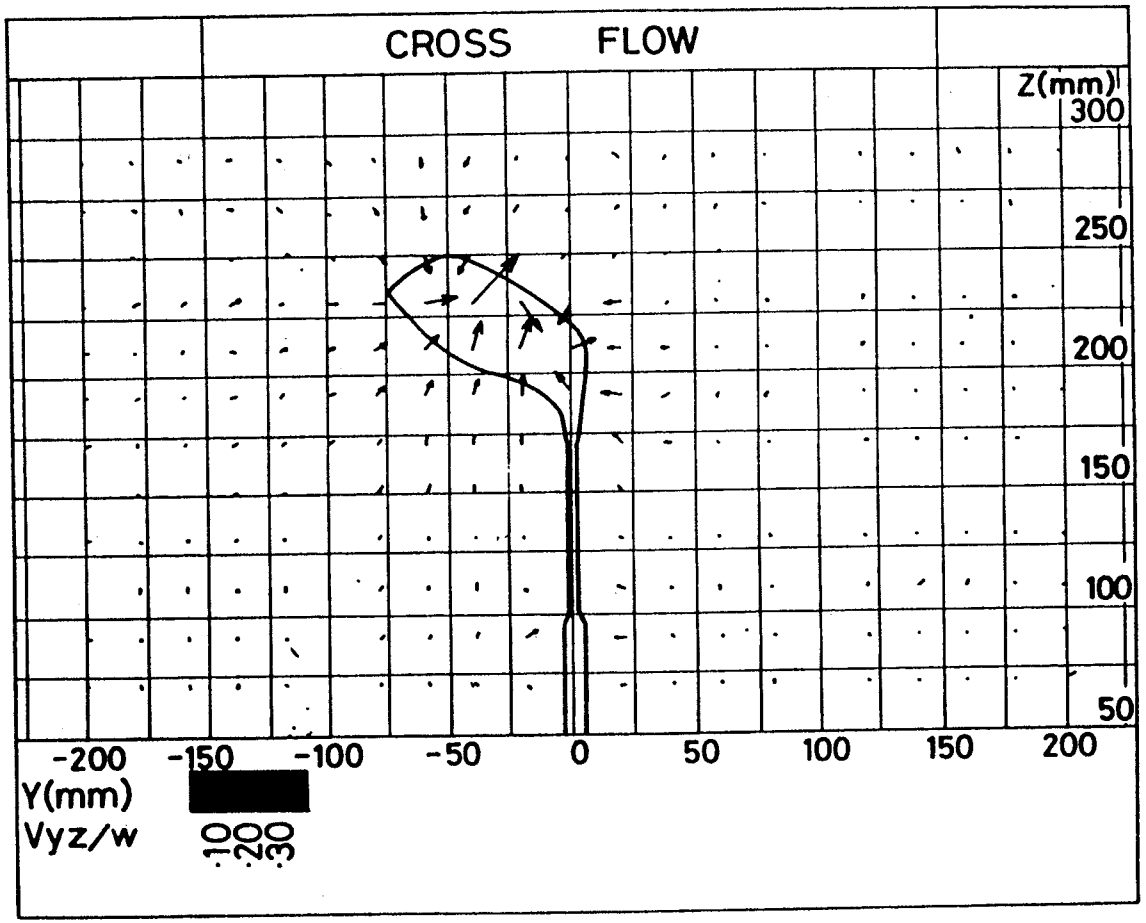
FIG. 23 illustrates an intersection of air flows generated around the golf club according to the present invention.
Figure 24:
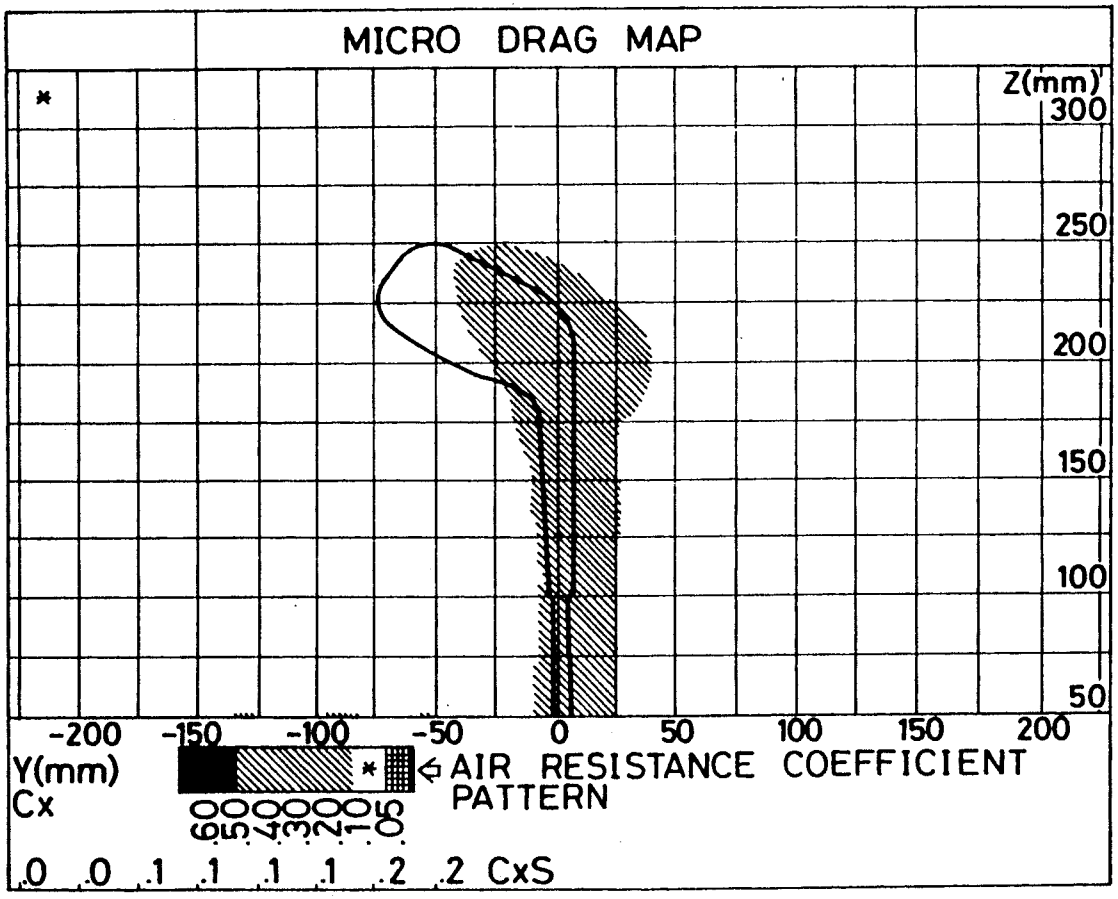
FIG. 24 illustrates a state of drag generated by the golf club according to the present invention.
Figure 25:
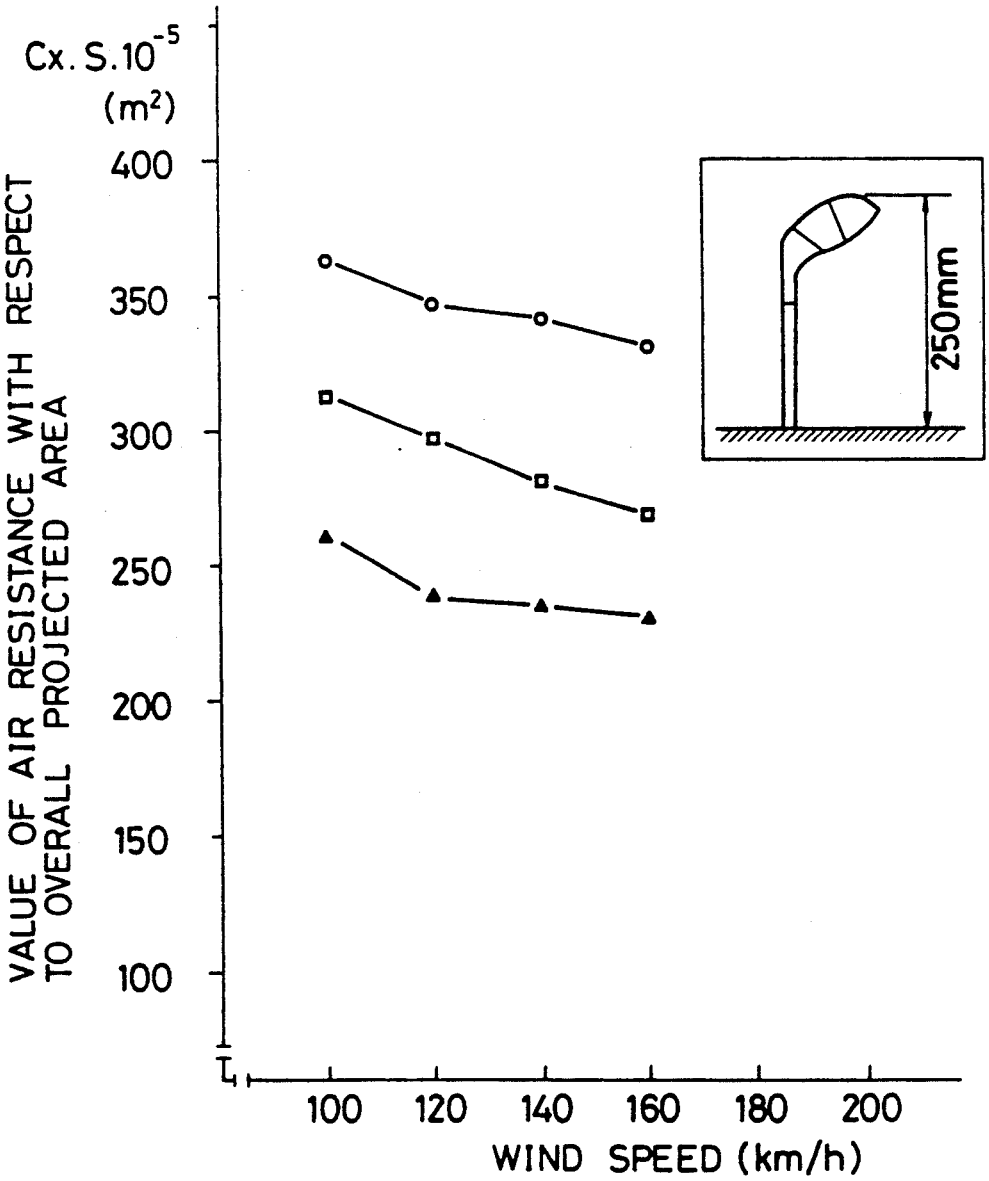
FIGS. 25 and 26 are graphs which illustrate air resistance coefficients of the head and the shaft of the golf club according to the present invention.
Figure 26:
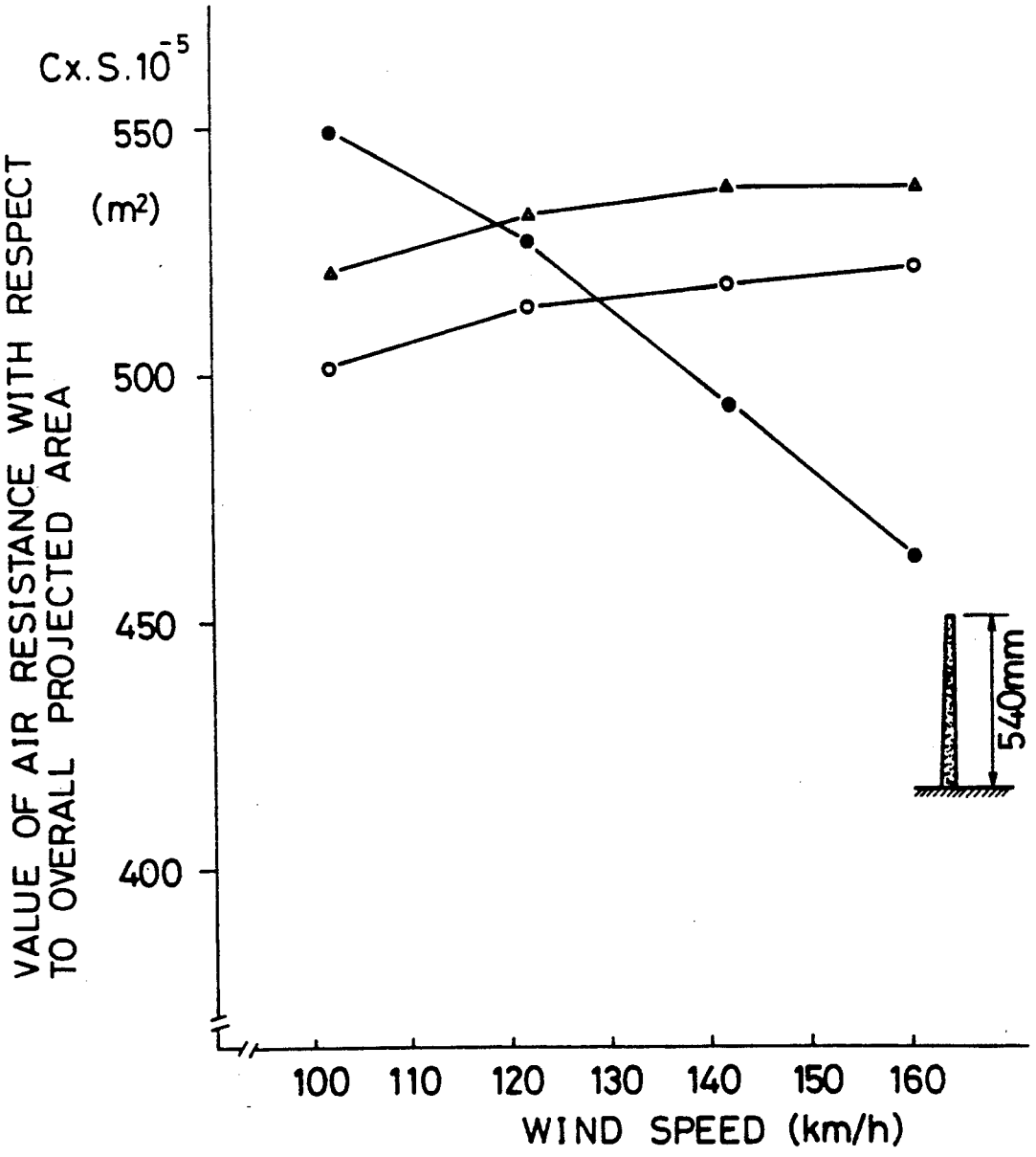
Figure 27:
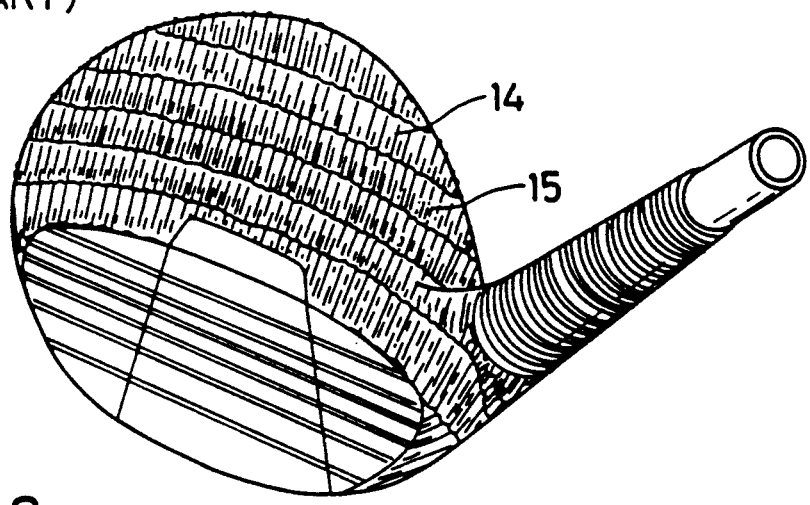
FIG. 27 (PRIOR ART)
FIGS. 27 to 29 are perspective views which illsutrate a conventional head capable of reducing the value of air resistance.
Figure 28:
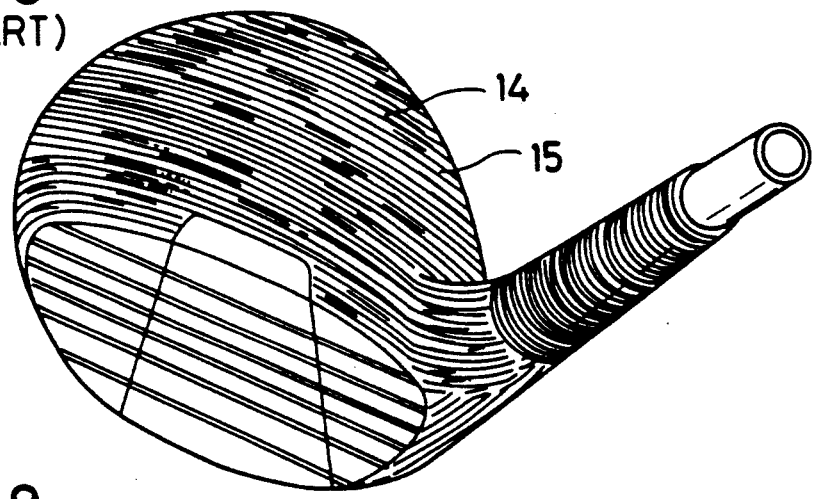
FIG. 28 (PRIOR ART)
Figure 29:
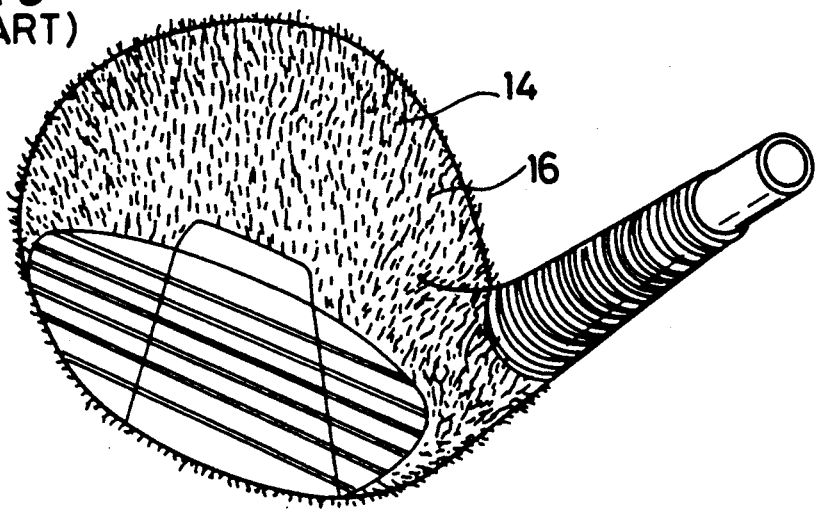
FIG. 29 (PRIOR ART)
Figure 30:
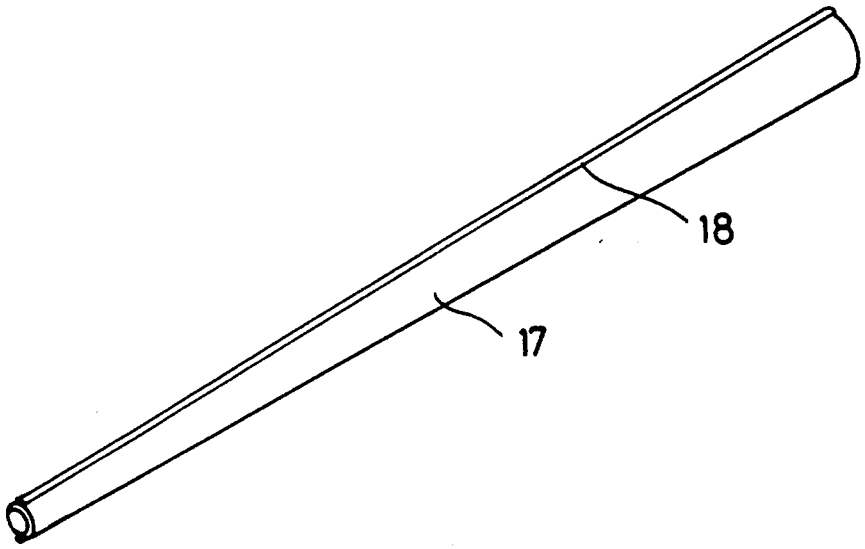
FIG. 30 (PRIOR ART)
FIGS. 30 and 31 are perspective views which illustrate conventional shufts capable of reducing the value of air resistance.
Figure 31:
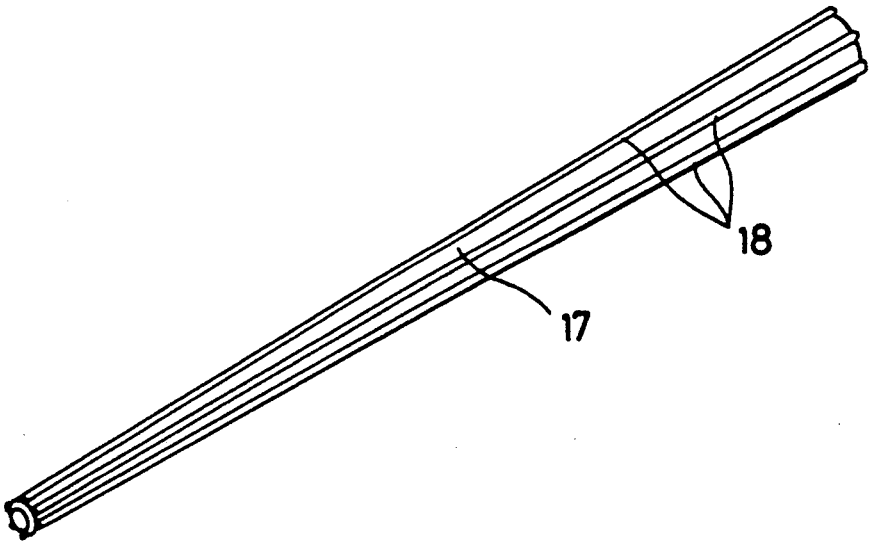
FIG. 31 (PRIOR ART)
Figure 32:
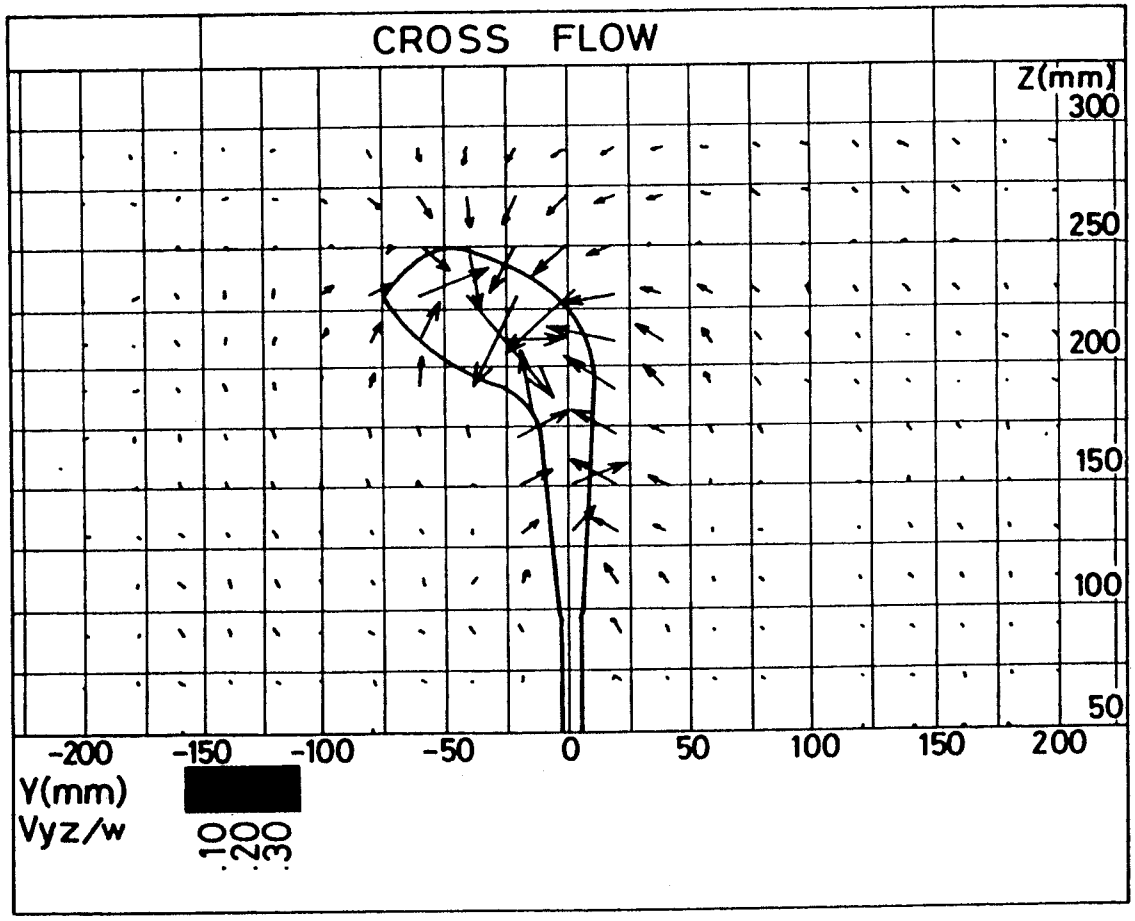
FIG. 32 (PRIOR ART)
FIG. 32 illustrates a state of an intersection of air flows generated around the conventional golf club.
Figure 33:
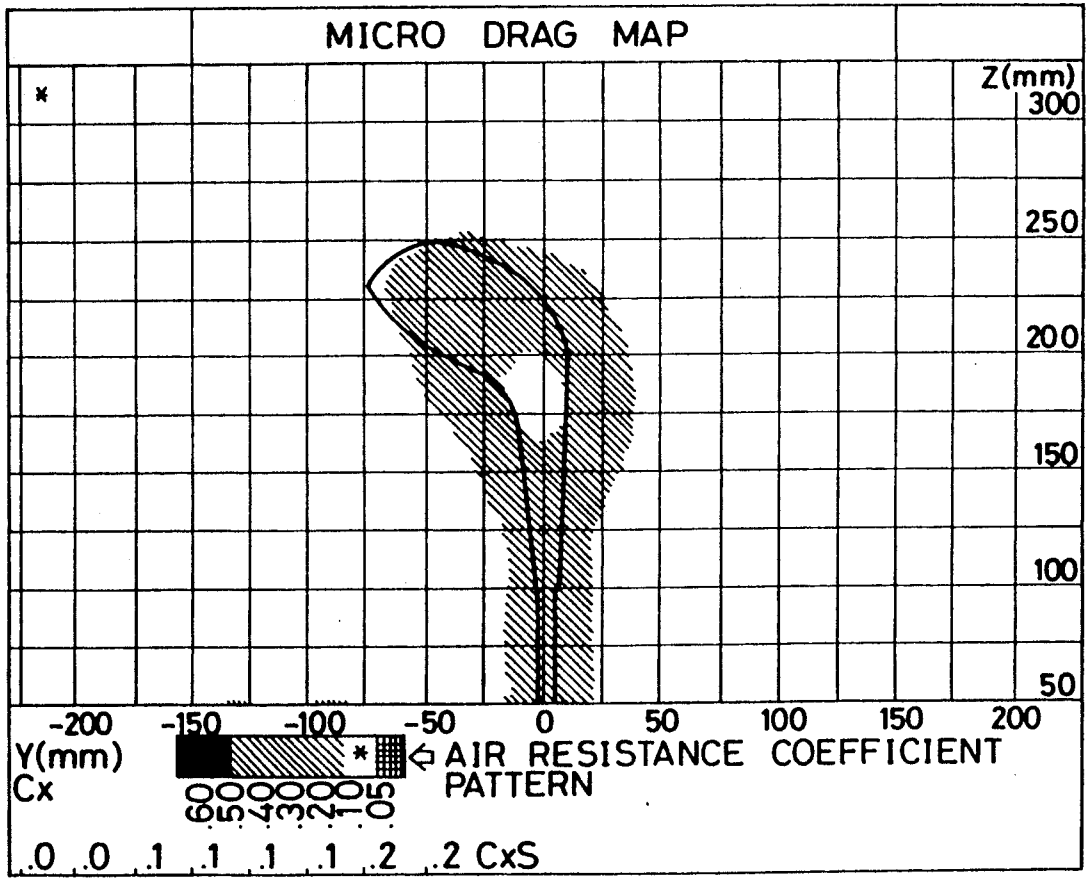
FIG. 33 (PRIOR ART)
FIG. 33 illustrates a state of drag generated by the conventional golf club.

FIG. 23 illustrates a state of intersection of air flows as a result of a wind tunnel experiment and FIG. 24 illustrates a state of drag as a result of the same, where an air flow passing in a direction from the face of the head toward the back portion is expressed as small dots denoting small resistance and is expressed as various arrows in the portions around the head and in the back portion. As can be clearly seen from FIGS. 23 and 24, the golf club according to the present invention reveals a significantly reduced number of the arrows in comparison to an ordinary head (see FIGS. 32 and 33). Furthermore, as shown in FIG. 24, the area in which the air resistance coefficient can be observed is reduced to a small area. As can be understood from this, the value of air resistance of the golf club according to the present invention can significantly be reduced.

Since the golf club according to the present invention is arranged in such a manner that the roughened surface portion is formed in only the portions of the head and the shaft from which the most significant effect can be obtained, unnecessary work can be eliminated, causing the manufacturing yield to be improved. Furthermore, a head having an annular roughened surface portion formed in the periphery of the face thereof reveals a reduced weight in comparison to a head which has been subjected to a conventional surface-roughening process.

Furthermore, the golf club according to the present invention is arranged in such a manner that the shape of the head is in the form of a substantially rectangular shape, the lengths of the neck portion and of the socket portion are shortened, the cross sectional shape of each of the above-described neck and socket portions is substantially elliptical streamlined in order to reduce the value of air resistance and the roughened surface portions are formed as desired. Therefore, the value of air resistance can significantly be reduced the head speed can be raised and the ball shooting range can thereby be lengthened significatly.

Furthermore, according to the present invention, the roughened surface portion can freely be formed in the head and a portion of the shaft adjacent to the head. Therefore, desired golf clubs for various golfers can freely be manufactured.

Another effect can be obtained in that a golfer is able to correctly address a ball at the time of hitting it, since the roughened surface portion is formed in the periphery of the face parallel to the surface of the face.

Although the invention has been described in its preferred form with a certain degree of particularly, it is understood that the present disclosure of the preferred form may be changed in the details of its construction. The the combination and arrangement of parts may be modified without departing from the spirit and the scope of the invention as hereinafter claimed.

What is claimed is:

1. A golf club comprising a head including a sole portion, a crown portion, a heel portion, a toe portion, a face portion and a back portion, a shaft and a grip, the ratio of the width from the heel portion to the toe portion, the thickness of the sole portion to the crown portion and the depth from the face portion to the back portion being substantially 2:1:1.6;

said head having a substantially rectangular shape; and a roughened surface portion having a predetermined width and a surface roughness and being capable of reducing the value of air resistance by forming a turbulent boundary layer around said head when said golf club is swung and being is annularly formed on a peripheral portion of said face portion of said head, wherein the width of said annular roughened surface portion on said peripheral portion of said face portion of said head is between 10 mm and 30 mm with the remainder of said head being substantially void of any surface roughness.

2. A golf club according to claim 1, wherein a top edge portion has a curvature radius of 60 mm to 80 mm, the crown portion has a curvature radius of 90 mm to 110 mm, and the sole portion has a curvature radius of 140 mm to 200 mm.

3. A golf club according to claim 1, wherein the surface roughness of said roughened surface portion is between 50μ and 300μ.

4. A golf club according to claim 1, wherein the surface roughness of said roughened surface portion is between 80μ and 200μ.

5. A golf club according to claim 1, wherein the surface roughness of said roughened surface portion is substantially 100μ.

6. A golf club according to claim 1, wherein the surface roughness of said roughened surface portion is gradually changed from rough to fine.

7. A golf club according to claim 1, wherein the surface roughness of said roughened surface portion is gradually changed from fine to rough.

8. A golf club according to claim 1, wherein said roughened surface portion comprises a granular material having a surface roughness of 50μ or more.

9. A golf club according to claim 1, wherein said roughened surface portion is manufactured by integrally forming a granular material with a synthetic resin.

10. A golf club according to claim 1, wherein said roughened surface portion is manufactured by integrally forming a granular material with a coating.

11. A golf club according to claim 1, wherein said roughened surface portion is formed by a roughening process selected from the group consisting of plating, ion plating, chemical vacuum deposition, physical vacuum deposition, honing, etching and dimple forming.

12. A golf club comprising a head including a sole portion, a crown portion, a heel portion, a toe portion, a face portion and a back portion, a shaft and a grip, the ratio of the width from the heel portion to the toe portion, the thickness of the sole to the crown portion and the depth from the face portion to the back portion being substantially 2:1:1.6, said head having a substantially rectangular shape; and a roughened surface portion capable of reducing the value of air resistance by forming a turbulent boundary layer around said head when said golf club is swung and being annularly formed on a peripheral portion of said face portion of said head, wherein the surface roughness of the roughened surface portion is gradually changed from rough to fine in a direction generally extending from said peripheral portion to said back portion.

13. A golf club comprising a head including a sole portion, a crown portion, a heel portion, a toe portion, a face portion and a back portion, a shaft and a grip, the ratio of the width from the heel portion to the toe portion, the thickness of the sole to the crown portion and the depth from the face portion to the back portion being substantially 2:1:1.6, said head having a substantially rectangular shape; and a roughened surface portion capable of reducing the value of air resistance by forming a turbulent boundary layer around said head when said golf club is swung and being annularly formed on a peripheral portion of said face portion of said head, wherein the surface roughness of the roughened surface portion is gradually changed from fine to rough in a direction generally extending from said peripheral portion to said back portion.

* * * * *